US009164447B2

(12) United States Patent
Kobashigawa et al.

(10) Patent No.: US 9,164,447 B2
(45) Date of Patent: Oct. 20, 2015

(54) FIXING DEVICE AND IMAGE FORMING APPARATUS

(71) Applicants: Shota Kobashigawa, Tokyo (JP); Susumu Matsusaka, Kanagawa (JP); Motokazu Hasegawa, Kanagawa (JP); Tsuyoshi Hashiyada, Tokyo (JP)

(72) Inventors: Shota Kobashigawa, Tokyo (JP); Susumu Matsusaka, Kanagawa (JP); Motokazu Hasegawa, Kanagawa (JP); Tsuyoshi Hashiyada, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/533,227

(22) Filed: Nov. 5, 2014

(65) Prior Publication Data

US 2015/0132019 A1 May 14, 2015

(30) Foreign Application Priority Data

Nov. 11, 2013 (JP) ..... 2013-232875
Mar. 26, 2014 (JP) ..... 2014-063437

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

| | | | | |
|---|---|---|---|---|
| 2006/0029411 | A1* | 2/2006 | Ishii et al. | 399/67 |
| 2006/0086727 | A1* | 4/2006 | Takematsu et al. | 219/619 |
| 2006/0289420 | A1 | 12/2006 | Hasegawa et al. | |
| 2008/0226326 | A1 | 9/2008 | Seo et al. | |
| 2011/0135355 | A1* | 6/2011 | Baba | 399/329 |

FOREIGN PATENT DOCUMENTS

| | | |
|---|---|---|
| JP | 2006-337693 | 12/2006 |
| JP | 2007-156065 | 6/2007 |
| JP | 2008-046531 | 2/2008 |
| JP | 2008-224953 | 9/2008 |
| JP | 2008-257155 | 10/2008 |
| JP | 2008-287136 | 11/2008 |
| JP | 2014-092610 | 5/2014 |

* cited by examiner

*Primary Examiner* — Sandra Brase
(74) *Attorney, Agent, or Firm* — Harness, Dickey & Pierce, P.L.C.

(57) ABSTRACT

A fixing device includes a pressurization member pressed against a fixing rotator and a magnetic flux generator disposed opposite the fixing rotator. A heat generator is disposed opposite the magnetic flux generator to generate heat by a magnetic flux generated by the magnetic flux generator. A magnetic shield is movably disposed inside the heat generator to screen the magnetic flux penetrating through the heat generator. A pressure adjuster presses the pressurization member against the fixing rotator with variable pressure. An interlock interlocks the pressurization member with the magnetic shield. The pressure adjuster presses the pressurization member against the fixing rotator with increased pressure to move the magnetic shield via the interlock to a proximate position in proximity to the heat generator and with decreased pressure to move the magnetic shield via the interlock to a remote position being remote from the heat generator.

20 Claims, 20 Drawing Sheets

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-232875, filed on Nov. 11, 2013, and 2014-063437, filed on Mar. 26, 2014, in the Japanese Patent Office, the entire disclosure of each of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressurization member, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressurization member apply heat and pressure to the recording medium, melting and fixing the toner image on the recording medium.

SUMMARY

At least one embodiment provides a novel fixing device that includes a fixing rotator rotatable in a given direction of rotation to heat a toner image on a recording medium and a pressurization member pressed against the fixing rotator to form a fixing nip therebetween through which the recording medium is conveyed. A magnetic flux generator is disposed opposite the fixing rotator to generate a magnetic flux. A heat generator is made of a magnetic shunt alloy and disposed opposite the magnetic flux generator to generate heat by the magnetic flux generated by the magnetic flux generator and heat the fixing rotator. A magnetic shield is movably disposed inside the heat generator to screen the magnetic flux penetrating through the heat generator. A pressure adjuster presses the pressurization member against the fixing rotator with variable pressure. An interlock interlocks the pressurization member with the magnetic shield. The pressure adjuster presses the pressurization member against the fixing rotator with increased pressure to move the magnetic shield via the interlock to a proximate position in proximity to the heat generator and with decreased pressure to move the magnetic shield via the interlock to a remote position being remote from the heat generator.

At least one embodiment provides a novel image forming apparatus that includes an image forming device to form a toner image and a fixing device, disposed downstream from the image forming device in a recording medium conveyance direction, to fix the toner image on a recording medium. The fixing device includes a fixing rotator rotatable in a given direction of rotation to heat the toner image on the recording medium and a pressurization member pressed against the fixing rotator to form a fixing nip therebetween through which the recording medium is conveyed. A magnetic flux generator is disposed opposite the fixing rotator to generate a magnetic flux. A heat generator is made of a magnetic shunt alloy and disposed opposite the magnetic flux generator to generate heat by the magnetic flux generated by the magnetic flux generator and heat the fixing rotator. A magnetic shield is movably disposed inside the heat generator to screen the magnetic flux penetrating through the heat generator. A pressure adjuster presses the pressurization member against the fixing rotator with variable pressure. An interlock interlocks the pressurization member with the magnetic shield. The pressure adjuster presses the pressurization member against the fixing rotator with increased pressure to move the magnetic shield via the interlock to a proximate position in proximity to the heat generator and with decreased pressure to move the magnetic shield via the interlock to a remote position being remote from the heat generator.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
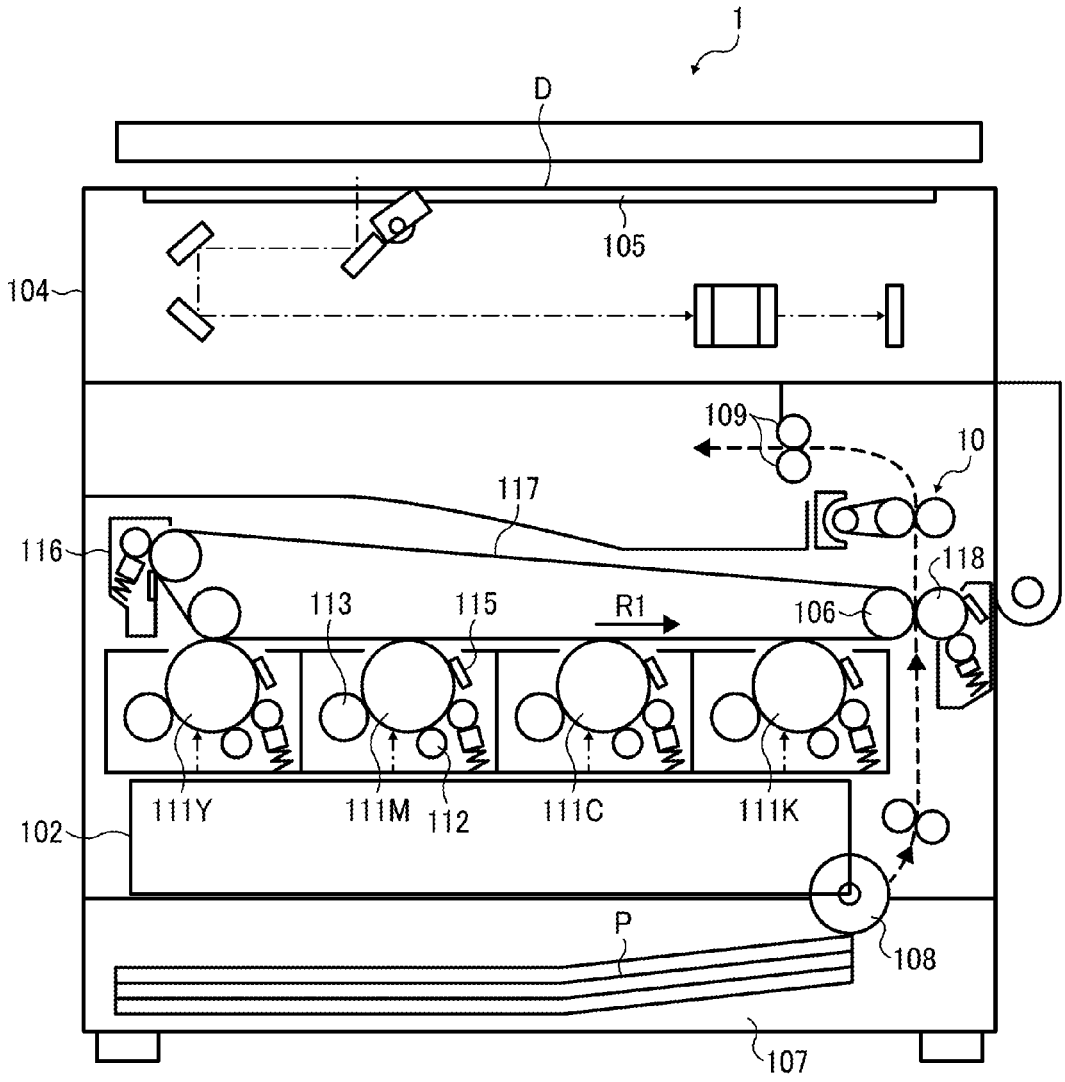
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a color copier that forms color and monochrome toner images on recording media by electrophotography. Alternatively, the image forming apparatus 1 may be a monochrome copier that forms monochrome toner images.

The image forming apparatus 1 has a typical structure constructed of a photoconductor and various components for forming a toner image, that surround the photoconductor, for example, a charger, an exposure device, and a development device. The image forming apparatus 1 further includes a scanner that reads an image on an original and a sheet feeder unit. Since the image forming apparatus 1 has the typical structure that performs a typical image forming operation, a brief description is provided of a construction and an image forming operation of the image forming apparatus 1. It is to be noted that an omitted description of the construction and image forming operation of the image forming apparatus 1 is also incorporated as long as they are typical.

The image forming apparatus 1 includes a tandem image forming portion located at a center section thereof and constructed of four image forming devices aligned substantially horizontally. The four image forming devices form yellow, magenta, cyan, and black toner images, respectively. The four image forming devices include drum-shaped photoconductors 111Y, 111M, 111C, and 111K serving as latent image carriers that carry electrostatic latent images, respectively. Each of the photoconductors 111Y, 111M, 111C, and 111K is surrounded by a charger 112, a development device 113, and a photoconductor cleaner 115. It is to be noted that the charger 112, the development device 113, and the photoconductor cleaner 115 that surround each of the photoconductors 111Y, 111C, and 111K are omitted.

Below the tandem image forming portion is an optical writing unit 102 serving as a latent image writer. The optical writing unit 102 emits a laser beam onto an outer circumferential surface of the respective photoconductors 111Y, 111M, 111C, and 111K according to image data sent from an original reader 104 disposed atop the image forming apparatus 1, thus forming electrostatic latent images corresponding to yellow, magenta, cyan, and black toner images to be formed on the photoconductors 111Y, 111M, 111C, and 111K, respectively. The original reader 104 includes a light source, a polygon mirror, an f-θ lens, and reflection mirrors. The original reader 104 irradiates an original D placed on an exposure glass 105 with light to read an image on the original D into image data, converts the image data into an electric signal, and sends the electric signal to the optical writing unit 102.

Immediately above the tandem image forming portion is an endless belt-shaped, intermediate transfer belt 117 serving as an intermediate transferor. The intermediate transfer belt 117 is looped over a plurality of support rollers including a driving roller, for example, a secondary transfer roller 106 having a rotation shaft connected to a driving motor serving as a driver. A belt cleaner 116 is situated upstream from the tandem image forming portion in a rotation direction R1 of the intermediate transfer belt 117. As the driving motor drives and rotates the secondary transfer roller 106, the secondary transfer roller 106 drives and rotates the intermediate transfer belt 117 counterclockwise in FIG. 1 in the rotation direction RI and at the same time the intermediate transfer belt 117 rotates the driven support rollers over which the intermediate transfer belt 117 is looped. Inside a loop formed by the intermediate transfer belt 117 is a primary transfer device that primarily transfers the yellow, magenta, cyan, and black toner images formed on the photoconductors 111Y, 111M, 111C, and 111K, respectively, onto the intermediate transfer belt 117.

Downstream from the primary transfer device in the rotation direction RI of the intermediate transfer belt 117 is the secondary transfer roller 106 serving as a secondary transferor. The secondary transfer roller 106 is disposed opposite a transfer support roller 118 via the intermediate transfer belt 117. The transfer support roller 118 serves as a pressurization member.

In a lower section of the image forming apparatus 1 are a paper tray 107 that loads a plurality of recording media P (e.g., sheets), a feed roller 108 that picks up and feeds a recording medium P from the paper tray 107, and a registration roller pair (e.g., a timing roller pair) that feeds the recording medium P to a secondary transfer nip formed between the secondary transfer roller 106 and the transfer support roller 118. Downstream from the secondary transfer nip in a recording medium conveyance direction are a fixing device 10 that fixes a toner image transferred from the intermediate transfer belt 117 onto the recording medium P thereon and an output roller pair 109.

With reference to FIG. 1, a description is provided of an image forming operation performed by the image forming apparatus 1 having the construction described above.

In the image forming devices, the photoconductors 111Y, 111M, 111C, and 111K are rotated. The charger 112 uniformly charges the outer circumferential surface of the respective photoconductors 111Y, 111M, 111C, and 111K as they rotate. The optical writing unit 102 emits a laser beam onto the charged outer circumferential surface of the respective photoconductors 111Y, 111M, 111C, and 111K, forming an electrostatic latent image thereon. Thereafter, the development device 113 supplies toner to the electrostatic latent image on the respective photoconductors 111Y, 111M, 111C, and 111K, visualizing the electrostatic latent images as yellow, magenta, cyan, and black toner images, respectively, thereon. The driving motor drives and rotates a driving roller, that is, the secondary transfer roller 106, thus rotating the intermediate transfer belt 117 and the support rollers contacting the intermediate transfer belt 117. As the intermediate transfer belt 117 rotates, the primary transfer device primarily transfers the yellow, magenta, cyan, and black toner images formed on the photoconductors 111Y, 111M, 111C, and 111K, respectively, onto the intermediate transfer belt 117 successively such that they are superimposed on a same position on the intermediate transfer belt 117. Thus, a color toner image is formed on the intermediate transfer belt 117. After transfer of the yellow, magenta, cyan, and black toner images from the photoconductors 111Y, 111M, 111C, and 111K onto the intermediate transfer belt 117, the photoconductor cleaner 115 removes residual toner from the outer circumferential surface of the respective photoconductors 111Y, 111M, 111C, and 111K, thus cleaning the photoconductors 111Y, 111M, 111C, and 111K for a next image forming operation.

The feed roller 108 picks up and feeds an uppermost recording medium P of the plurality of recording media P loaded on the paper tray 107 to the registration roller pair at a proper time when the color toner image is formed on the intermediate transfer belt 117. Thereafter, the registration roller pair halts the recording medium P temporarily. The registration roller pair conveys the recording medium P to the secondary transfer nip formed between the intermediate transfer belt 117 and the transfer support roller 118 disposed opposite the secondary transfer roller 106 via the intermediate transfer belt 117 at a time when the color toner image formed on the intermediate transfer belt 117 reaches the secondary transfer nip. The intermediate transfer belt 117 and the transfer support roller 118 sandwich the recording medium P at the secondary transfer nip. The secondary transfer roller 106 secondarily transfers the color toner image formed on the intermediate transfer belt 117 onto the recording medium P. A separator separates the recording medium P bearing the color toner image from the intermediate transfer belt 117 and the transfer support roller 118. The recording medium P is conveyed to the fixing device 10 that fixes the toner image on the recording medium P. Thereafter, the recording medium P bearing the fixed toner image is discharged onto an outside of the image forming apparatus 1 by the output roller pair 109. On the other hand, the belt cleaner 116 removes residual toner remaining on the intermediate transfer belt 117 after the secondary transfer from the intermediate transfer belt 117, rendering the intermediate transfer belt 117 to be ready for the next image forming operation performed by the tandem image forming portion.

Figure 2:
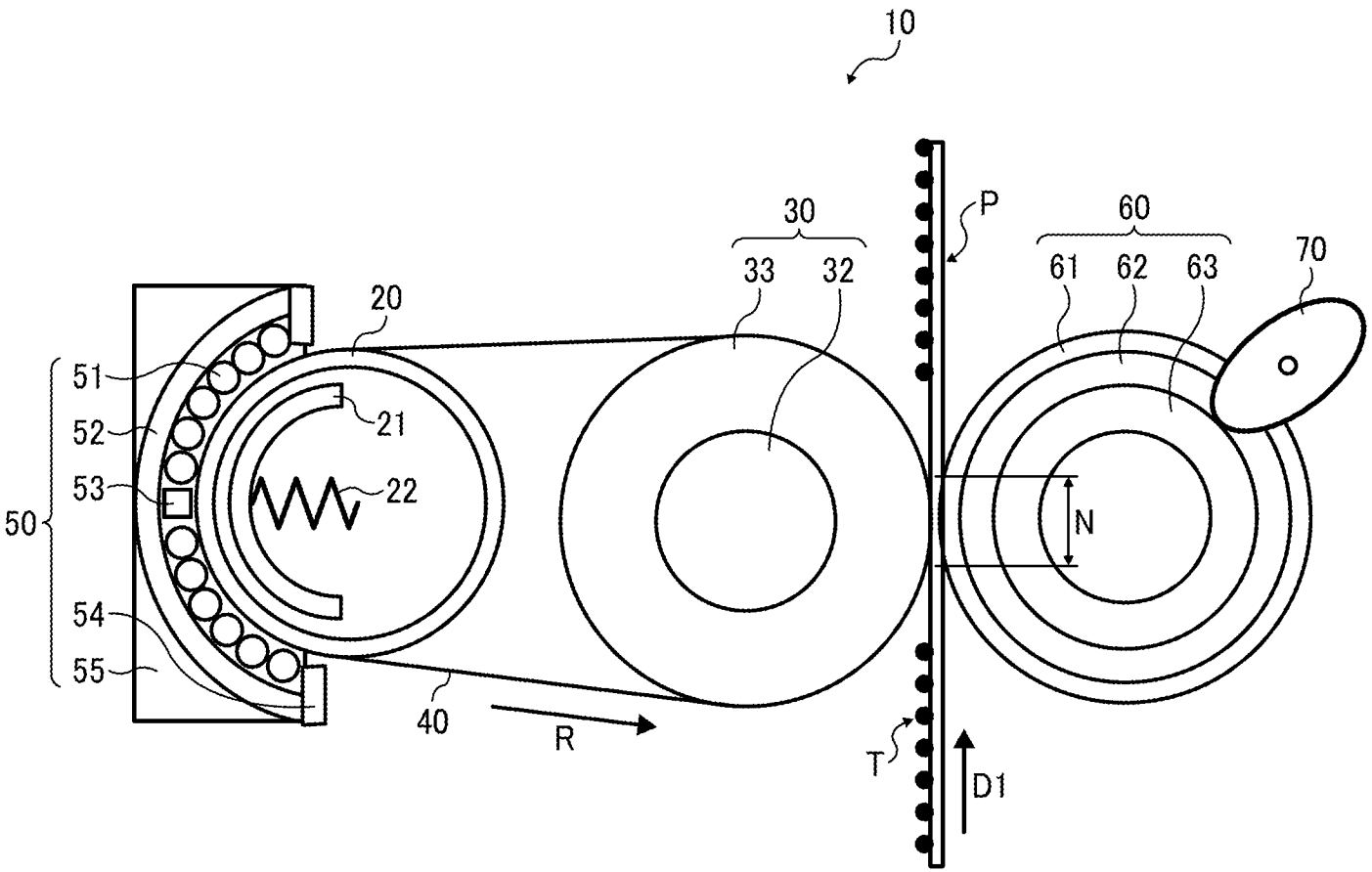
FIG. 2 is a schematic vertical sectional view of a fixing device according to a first example embodiment incorporated in the image forming apparatus shown in FIG. 1.

With reference to FIG. 2, a description is provided of a construction of the fixing device 10 according to a first example embodiment incorporated in the image forming apparatus 1 described above.

FIG. 2 is a vertical sectional view of the fixing device 10. As shown in FIG. 2, the fixing device 10 (e.g., a fuser) includes a heating roller 20 (e.g., a support roller) serving as a heating member and a heat generator incorporating a heat generation layer; an aluminum member 21 serving as a magnetic shield; a fixing roller 30; a fixing belt 40 serving as a fixing member or a fixing rotator looped over the heating roller 20 and the fixing roller 30; an induction heater 50 serving as a magnetic flux generator disposed opposite the heating roller 20 via the fixing belt 40; a pressure roller 60 serving as a pressurization member pressed against the fixing roller 30 via the fixing belt 40 to form a fixing nip N between the fixing belt 40 and the pressure roller 60; and a cam 70 serving as a pressure adjuster that presses the pressure roller 60 against the fixing roller 30 via the fixing belt 40 or releases pressure between the pressure roller 60 and the fixing belt 40, thus adjusting pressure between the pressure roller 60 and the fixing belt 40 at the fixing nip N.

A detailed description is now given of a configuration of the heating roller 20.

The heating roller 20 is a tubular rotation body and made of a magnetic shunt alloy serving as a magnetic shunt material having a Curie temperature in a range of from about 160 degrees centigrade to about 220 degrees centigrade. The magnetic shunt alloy constitutes the heat generation layer. Alternatively, the surface magnetic shunt alloy layer may be coated with a copper layer, as a heat generation layer, having a thickness in a range of from about 3 micrometers to about 15 micrometers. The copper layer coating the magnetic shunt alloy layer enhances heat generation efficiency of the heat generation layer. The surface copper layer may be coated with nickel to prevent rust.

A detailed description is now given of a configuration of the aluminum member 21.

The aluminum member 21 is semitubular or arcuate and is situated inside the heating roller 20. The aluminum member 21 is disposed opposite and curved along an inner circumferential surface of the heating roller 20. Thus, the aluminum member 21 stops temperature increase of the fixing device 10 at a temperature near the Curie temperature. The aluminum member 21 has a thickness in a range of from about 0.6 mm to about 2.0 mm.

The aluminum member 21 is attached with a compression spring 22. As the compression spring 22 expands and contracts, the aluminum member 21 comes into contact with and separates from the heating roller 20. A detailed description of movement of the aluminum member 21 and the compression spring 22 is deferred.

A detailed description is now given of a configuration of the fixing roller 30.

The fixing roller 30 is constructed of a core metal 32 and an elastic layer 33 coating the core metal 32. For example, the core metal 32 is made of metal such as stainless steel and carbon steel. The elastic layer 33 is made of heat resistant, solid silicone rubber or silicone rubber foam. The pressure roller 60 is pressed against the fixing roller 30 via the fixing belt 40 to form the fixing nip N between the fixing belt 40 and the pressure roller 60, that is, a contact portion, having a given length in a recording medium conveyance direction D1. The fixing roller 30 has an outer diameter in a range of from about 30 mm to about 40 mm. The elastic layer 33 has a thickness in a range of from about 3 mm to about 10 mm and a hardness in a range of from about 10 degrees to about 50 degrees under Japanese Industrial Standard (JIS)-A.

A detailed description is now given of a configuration of the fixing belt 40.

Figure 3:
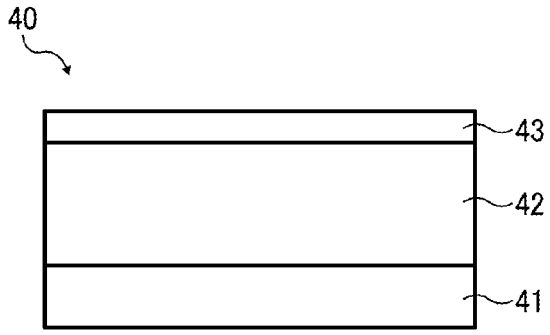
FIG. 3 is a schematic sectional view of a fixing belt incorporated in the fixing device shown in FIG. 2.

FIG. 3 is a schematic sectional view of the fixing belt 40. As shown in FIG. 3, the fixing belt 40 is constructed of a base layer 41, an elastic layer 42 layered on the base layer 41, and a release layer 43 layered on the elastic layer 42. The base layer 41 has a mechanical strength and a flexibility durable against load imposed as the fixing belt 40 is stretched taut across the heating roller 20 and the fixing roller 30 and a heat resistance durable against usage under a fixing temperature. For example, the base layer 41 used to heat the heating roller 20 by induction heating is made of insulative, heat resistant resin, polyimide, polyimideamide, polyether ether ketone (PEEK), polyether sulfone (PES), polyphenylene sulfide (PPS), fluoroplastic, or the like. The base layer 41 has a thickness in a range of from about 30 micrometers to about 200 micrometers in view of thermal capacity and mechanical strength.

The elastic layer 42 attains flexibility of a surface of the fixing belt 40 to apply gloss to a toner image T on a recording medium P evenly. For example, the elastic layer 42 has a rubber hardness in a range of from about 5 degrees to about 50 degrees under JIS-A and a thickness in a range of from about 50 micrometers to about 500 micrometers. The elastic layer 42 is made of silicone rubber, fluoro silicone rubber, or the like to attain heat resistance at the fixing temperature.

The release layer 43 is made of fluoroplastic such as polytetrafluoroethylene (PTFE), tetrafluoroethylene-perfluoroalkylvinylether copolymer (PFA), tetrafluoroethylene-hexafluoropropylene copolymer (FEP), a mixture of those resin, heat resistant resin dispersed with those fluoroplastic, or the like.

If the release layer 43 made of the above materials coats the elastic layer 42, the release layer 43 facilitates separation of toner of the toner image T on the recording medium P from the fixing belt 40 and prevents paper dust from adhering to the fixing belt 40 even without silicone oil or the like, thus attaining an oilless configuration of the fixing belt 40. However, since resin facilitating separation of toner of the toner image T does not have elasticity that rubber has, if the thick release layer 43 is layered on the elastic layer 42, the thick release layer 43 may degrade flexibility of the surface of the fixing belt 40, causing variation in gloss of the toner image T on the recording medium P. To address this circumstance, the release layer 43 has a film thickness in a range of from about 5 micrometers to about 50 micrometers, preferably, in a range of from about 10 micrometers to about 30 micrometers, thus facilitating separation of toner of the toner image T and achieving flexibility of the surface of the fixing belt 40.

Alternatively, a primer layer may be provided between the base layer 41 and the elastic layer 42 and between the elastic layer 42 and the release layer 43 as needed. A slide aid layer that enhances durability against friction that generates as the fixing belt 40 slides over the heating roller 20 and the fixing roller 30 may coat an inner circumferential surface of the base layer 41. The base layer 41 may incorporate a heat generation layer. For example, the base layer 41 made of polyimide or the like may mount a copper layer having a thickness in a range of from about 3 micrometers to about 15 micrometers as a heat generation layer.

A detailed description is now Liven of a configuration of the induction heater 50.

As shown in FIG. 2, the induction heater 50 includes a case 55, a coil 51, and magnetic cores. The magnetic cores include arch cores 52, side cores 54, and a center core 53. The arch cores 52 are disposed opposite a substantially half of the heating roller 20 opposite another substantially half thereof disposed opposite the fixing roller 30 and curved along an outer circumferential surface of the heating roller 20. The arch cores 52 and the heating roller 20 sandwich the coil 51. Each of the side cores 54 projects from each end of the arch core 52 in a circumferential direction thereof toward the heating roller 20 and extends in an axial direction of the heating roller 20. The center core 53 projects from a center of the arch core 52 in the circumferential direction thereof toward the heating roller 20 and extends in the axial direction of the heating roller 20.

The arch cores 52, the center core 53, and the side cores 54 constituting the magnetic cores produce a magnetic path that concentrates magnetic fluxes generated by the coil 51 onto the heating roller 20. A plurality of arch cores 52 is aligned in a longitudinal direction, that is, the axial direction, of the heating roller 20 with a given interval between the adjacent arch cores 52 to even temperature distribution of the heating roller 20 in the longitudinal direction thereof. The arch cores 52, the center core 53, and the side cores 54 are made of a soft magnetic material having a decreased magnetism retention, an increased magnetic permeability, and an increased electric resistivity. The arch cores 52, the center core 53, and the side cores 54 are made of Mn—Zn ferrite, Ni—Zn ferrite, or the like. Alternatively, the arch cores 52, the center core 53, and the side cores 54 may be made of permalloy or the like.

The coil 51 includes Litz wire constructed of about 50 to 500 twisted strands insulated electrically from each other, each of which is a conductor having a diameter in a range of from about 0.05 mm to about 0.20 mm. The Litz wire is wound round 5 to 20 times. The Litz wire includes a surface fusion layer. The fusion layer is solidified as it is heated by power or in a thermostatic oven, thus retaining the shape of the wound coil 51. Alternatively, Litz wire not incorporating a surface fusion layer and being wound round into the coil 51 may be shaped by press molding. Since Litz wire is requested to have heat resistance against temperatures not lower than the fixing temperature, heat resistant, insulative resin such as polyamideimide and polyimide is used as an insulative material that coats element wire.

The wound coil 51 is adhered to the case 55 with a silicone adhesive or the like. The case 55 requested to have heat resistance against temperatures not lower than the fixing temperature is made of heat resistant resin such as polyethyleneterephthalate (PET) and liquid crystal polymer.

Figure 4:
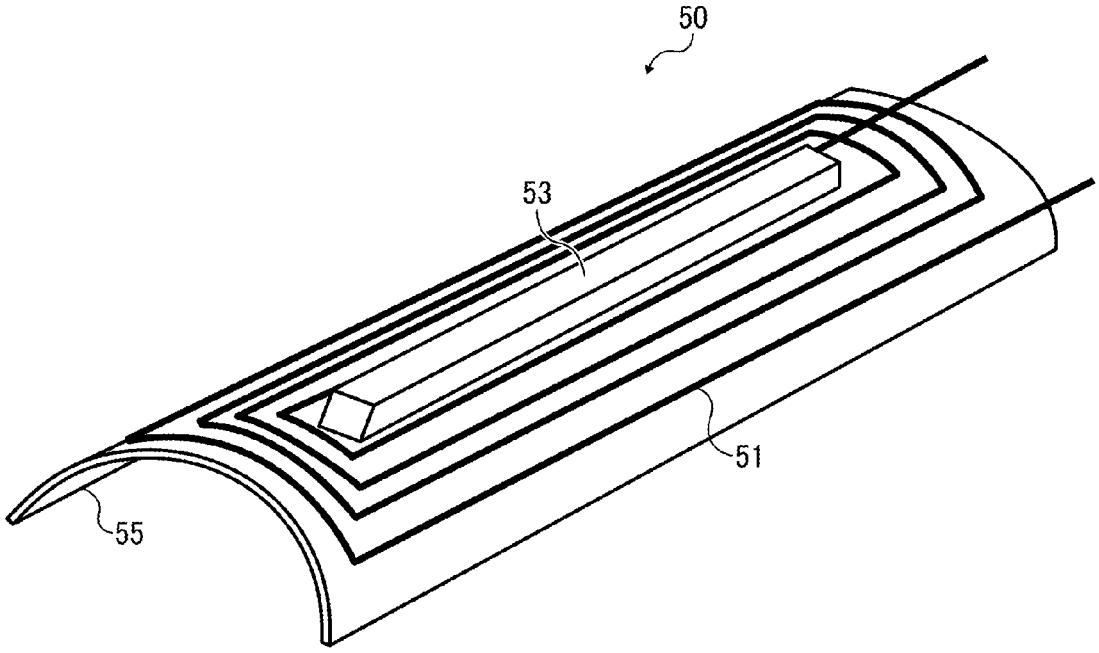
FIG. 4 is a perspective view of an induction heater incorporated in the fixing device shown in FIG. 2.

FIG. 4 is a perspective view of the induction heater 50. As shown in FIG. 4, the coil 51 is produced by bundling 90 insulated copper wire, each of which has an outer diameter of about 0.15 mm, into a flux and winding the flux around the center core 53. The flux is placed throughout an entire bulge face of the case 55 contoured or molded into an arch that covers the heating roller 20 serving as a heat generator. The coil 51 is coiled around the center core 53 as an axis and extended along the outer circumferential surface of the heating roller 20.

A detailed description is now given of a configuration of the pressure roller 60.

As shown in FIG. 2, the pressure roller 60 is constructed of a release layer 61, a heat resistant elastic layer 62, and a tubular core metal 63 made of metal. The pressure roller 60 is pressed against the fixing roller 30 via the fixing belt 40 to form the fixing nip N between the fixing belt 40 and the pressure roller 60. The pressure roller 60 has an outer diameter in a range of from about 30 mm to about 40 mm.

The elastic layer 62 has a thickness in a range of from about 0.3 mm to about 5.0 mm and an Asker hardness in a range of from about 20 degrees to about 50 degrees. The elastic layer 62 requested to be heat resistant is made of silicone rubber. In order to facilitate separation of toner of the fixed toner image T on the recording medium P from the pressure roller 60 during duplex printing, the elastic layer 62 mounts the release layer 61 made of fluoroplastic and having a thickness in a range of from about 10 micrometers to about 100 micrometers.

Since the pressure roller 60 has a hardness greater than that of the fixing roller 30, the pressure roller 60 deforms the fixing roller 30 and the fixing belt 40 into a recess at the fixing nip N. The recess of the fixing roller 30 and the fixing belt 40 has a curvature that prohibits the recording medium P from adhering to the outer circumferential surface of the fixing belt 40 at an exit of the fixing nip N, facilitating separation of the recording medium P from the fixing belt 40.

A detailed description is now given of a configuration of the cam 70.

The cam 70 is in contact with the core metal 63 and is driven and rotated by a driver such as a motor to lift and lower the core metal 63 reversibly. As the cam 70 lifts the pressure roller 60 or presses the pressure roller 60 against the fixing roller 30 via the fixing belt 40 with increased pressure, the pressure roller 60 deforms the fixing belt 40 and the fixing roller 30 to form the fixing nip N between the fixing belt 40 and the pressure roller 60. Conversely, as the cam 70 lowers the pressure roller 60 or presses the pressure roller 60 against the fixing roller 30 via the fixing belt 40 with decreased pressure, the pressure roller 60 eliminates deformation of the fixing belt 40 and the fixing roller 30 to cancel the recess of the fixing belt 40 and the fixing roller 30 produced at the fixing nip N or releases pressure between the pressure roller 60 and the fixing belt 40. A detailed description of movement of the cam 70 is deferred.

A description is provided of an operation of the fixing device 10 having the construction described above.

As shown in FIG. 2, the fixing belt 40 is rotatable in a rotation direction R. The induction heater 50 heats the heating roller 20.

For example, as the induction heater 50 is applied with a high-frequency alternating current in a range of from about 10 kHz to about 1 MHz, the direction of magnetic lines of force inside a loop of the induction heater 50 is alternately switched bidirectionally, producing an alternating magnetic field. The alternating magnetic field generates an eddy current in the heating roller 20 that in turn generates Joule heat, thus heating the heating roller 20 by induction heating.

The Joule heat generated by the heating roller 20 is conducted to the fixing belt 40. As the fixing belt 40 contacts the recording medium P conveyed through the fixing nip N, the fixing belt 40 heats the toner image T on the recording medium P, melting and fixing the toner image T on the recording medium P.

A description is provided of a relation between the cam 70 and the aluminum member 21.

As shown in FIG. 2, the aluminum member 21 and the compression spring 22 are located inside the heating roller 20. As the compression spring 22 expands and contracts, the aluminum member 21 moves in a direction in which it comes closer to the heating roller 20 and a direction in which it separates away from the heating roller 20. On the other hand, the cam 70 contacting the core metal 63 of the pressure roller 60 is driven and rotated to change pressure exerted to the core metal 63. The cam 70 lifts the pressure roller 60 or moves the pressure roller 60 toward the fixing belt 40 to press the pressure roller 60 against the fixing roller 30 via the fixing belt 40 at the fixing nip N with increased pressure. Conversely, the cam 70 lowers the pressure roller 60 or moves the pressure roller 60 away from the fixing belt 40 to release pressure between the pressure roller 60 and the fixing belt 40 at the fixing nip N.

Figure 5:
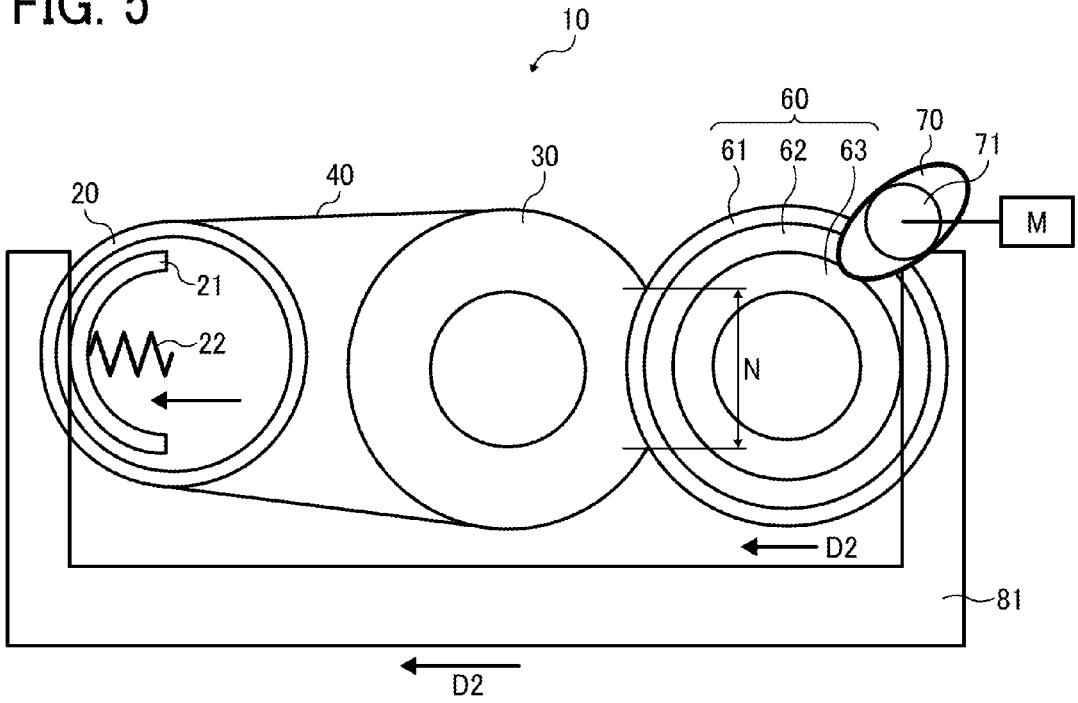
FIG. 5 is a schematic vertical sectional view of the fixing device shown in FIG. 2 as a pressure roller is pressed against the fixing belt with increased pressure.
Figure 6:
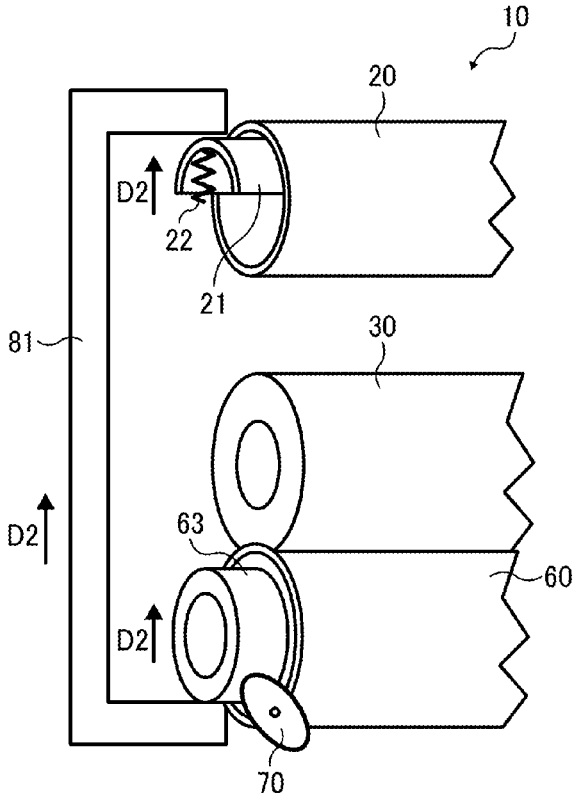
FIG. 6 is a partial schematic perspective view of the fixing device shown in FIG. 5.

FIG. 5 is a schematic vertical sectional view of the fixing device 10. FIG. 6 is a partial schematic perspective view of the fixing device 10. As shown in FIG. 5, an aluminum member adjustment plate 81 serving as an interlock sandwiches the aluminum member 21 and the pressure roller 60 in a pressurization direction D2 in which the pressure roller 60 is pressed against the fixing roller 30 via the fixing belt 40. The aluminum member adjustment plate 81 is in contact or connection with the aluminum member 21 and the core metal 63 of the pressure roller 60 and moves in accordance with movement of the core metal 63 of the pressure roller 60, thus moving the aluminum member 21 in accordance with movement of the pressure roller 60. Although FIG. 5 illustrates the aluminum member adjustment plate 81 overlapping components of the fixing device 10 other than the aluminum member 21 and the pressure roller 60, the aluminum member adjustment plate 81 contacts the aluminum member 21 and a lateral end of the core metal 63 in an axial direction of the pressure roller 60 and does not contact the components of the fixing device 10 other than the aluminum member 21 and the core metal 63 of the pressure roller 60 as shown in FIG. 6. The aluminum member adjustment plate 81 is made of metal such as stainless steel.

FIGS. 5 and 6 illustrate the position of the components of the fixing device 10 as the pressure roller 60 is pressed against the fixing roller 30 via the fixing belt 40 to convey the recording medium P through the fixing nip N. FIG. 5 is a sectional view of the fixing device 10. FIG. 6 is a perspective view of the fixing device 10 illustrating one lateral end of the heating roller 20, the fixing roller 30, and the pressure roller 60 in an axial direction thereof FIG. 6 does not illustrate the fixing belt 40.

As the cam 70 rotates and moves the pressure roller 60 toward the fixing belt 40 in the pressurization direction D2, the pressure roller 60 is pressed against the fixing roller 30 via the fixing belt 40 with increased pressure, forming the fixing nip N between the fixing belt 40 and the pressure roller 60. In accordance with movement of the pressure roller 60, the core metal 63 of the pressure roller 60, the aluminum member 21, and the aluminum member adjustment plate 81 interlocking the core metal 63 with the aluminum member 21 also move in the pressurization direction D2. The aluminum member 21 moves in a diametrical direction of the heating roller 20 to a proximate position in proximity to the heating roller 20 where a first interval in a range of from about 0.4 mm to about 20 mm is provided between the aluminum member 21 and the heating roller 20.

Figure 7:
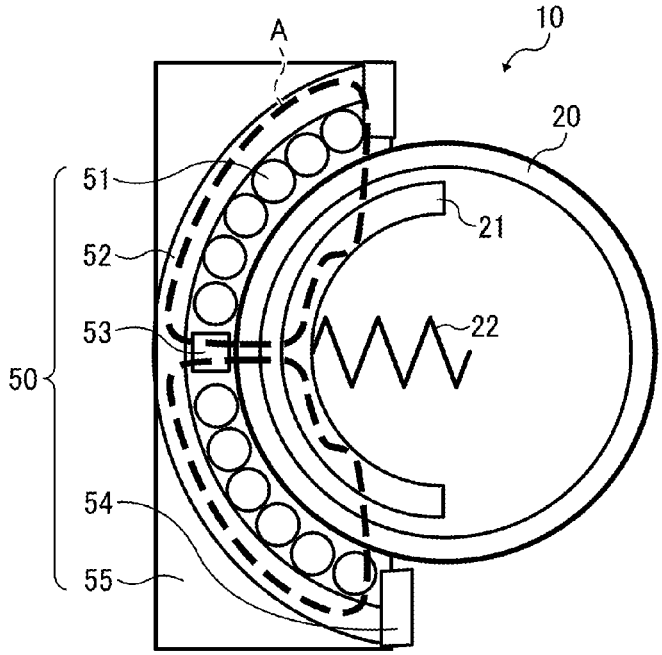
FIG. 7 is a vertical sectional view of a heating roller and the induction heater incorporated in the fixing device shown in FIG. 5.

FIG. 7 is a vertical sectional view of the heating roller 20 and the induction heater 50. As shown in FIG. 7, a magnetic flux A generated by the induction heater 50 penetrates through the magnetic shunt alloy of the heating roller 20 at an overheating portion of the fixing belt 40 where the recording medium P is not conveyed and is screened by the aluminum member 21 situated inside the heating roller 20. Accordingly, overheating of the fixing belt 40 is prevented.

Figure 8:
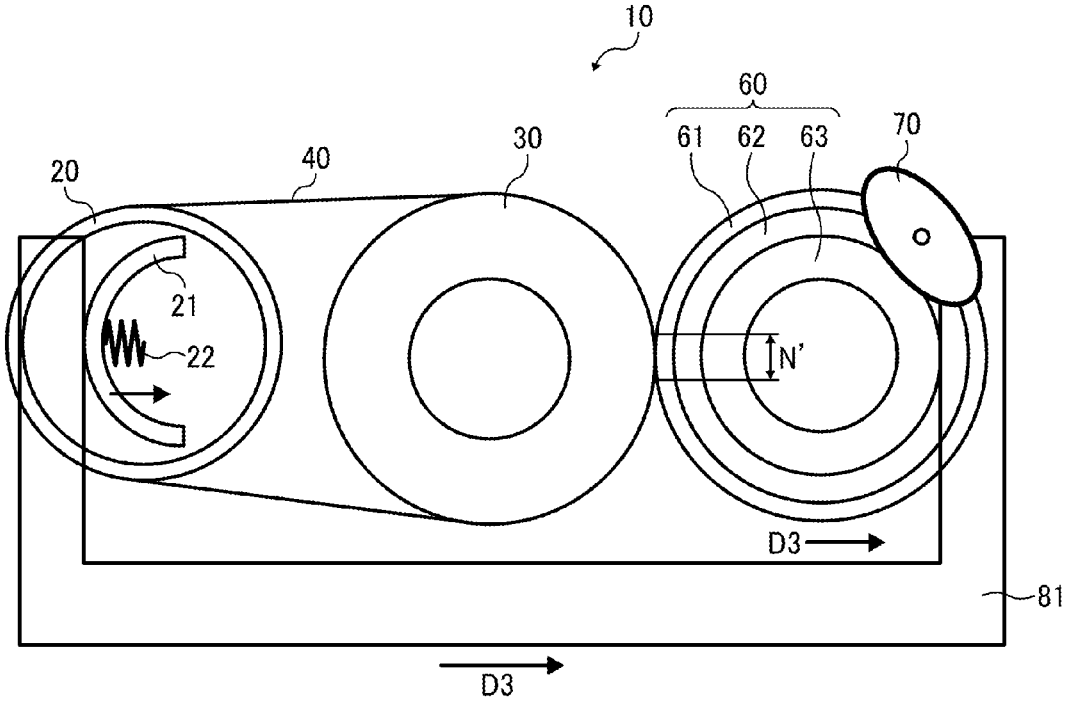
FIG. 8 is a schematic vertical sectional view of the fixing device shown in FIG. 2 as the pressure roller is pressed against the fixing belt with decreased pressure.
Figure 9:
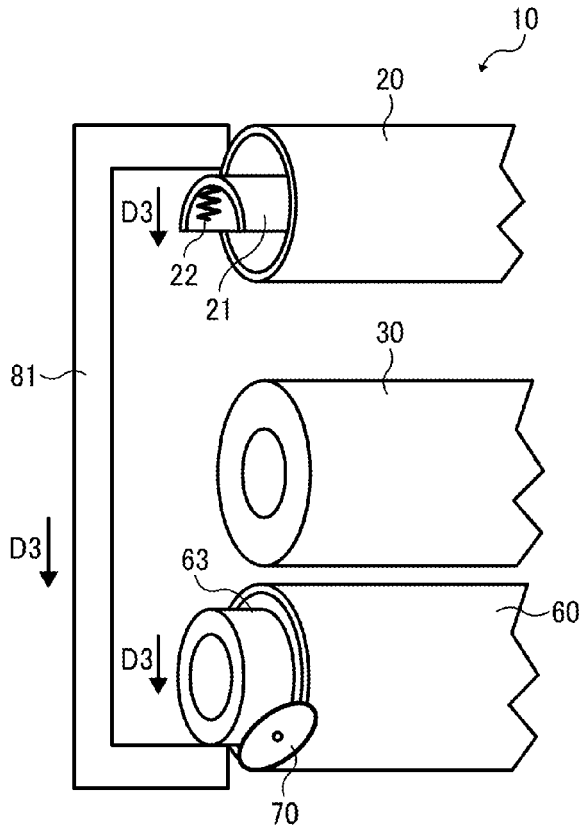
FIG. 9 is a partial schematic perspective view of the fixing device shown in FIG. 8.

FIGS. 8 and 9 illustrate the position of the components of the fixing device 10 as the pressure roller 60 releases pressure exerted to the fixing roller 30 via the fixing belt 40 to warm up the fixing device 10. FIG. 8 is a schematic vertical sectional view of the fixing device 10. FIG. 9 is a partial schematic perspective view of the fixing device 10 illustrating one lateral end of the heating roller 20, the fixing roller 30, and the pressure roller 60 in the axial direction thereof FIG. 9 does not illustrate the fixing belt 40.

As the cam 70 rotates and moves the pressure roller 60 away from the fixing belt 40 in a depressurization direction D3, the pressure roller 60 is pressed against the fixing roller 30 via the fixing belt 40 with decreased pressure or no pressure, forming a fixing nip N' between the fixing belt 40 and the pressure roller 60. According to this example embodiment, even when the pressure roller 60 is pressed against the fixing roller 30 via the fixing belt 40 with decreased pressure, the fixing nip N' is formed between the fixing belt 40 and the pressure roller 60. Alternatively, the pressure roller 60 may be isolated from the fixing belt 40, forming no fixing nip therebetween. In accordance with movement of the pressure roller 60, the core metal 63 of the pressure roller 60, the aluminum member 21, and the aluminum member adjustment plate 81 interlocking the core metal 63 with the aluminum member 21 also move in the depressurization direction D3. The aluminum member 21 moves in the diametrical direction of the heating roller 20 to a remote position being remote from the heating roller 20 where a second interval greater than the first interval created as the fixing nip N is formed between the fixing belt 40 and the pressure roller 60 as shown in FIG. 5 by a distance in a range of from about 3.0 mm to about 5.0 mm provided between the aluminum member 21 and the heating roller 20.

Figure 10:
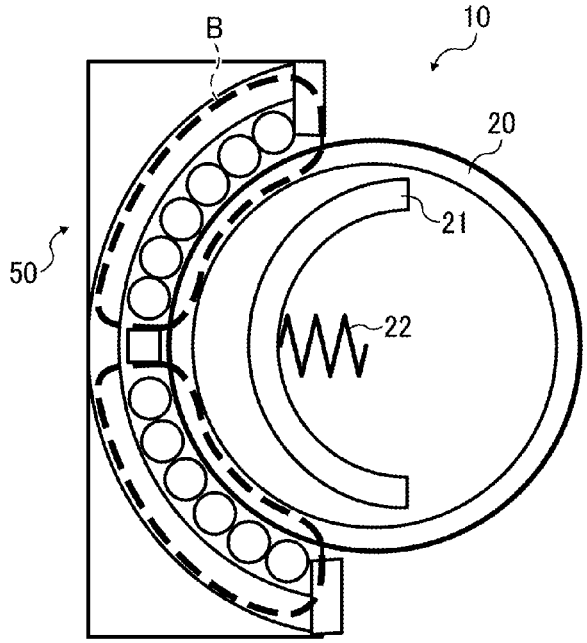
FIG. 10 is a vertical sectional view of the heating roller and the induction heater incorporated in the fixing device shown in FIG. 8.

FIG. 10 is a vertical sectional view of the heating roller 20 and the induction heater 50. As shown in FIG. 10, since a sufficient interval is provided between the heating roller 20 and the aluminum member 21, even when the temperature of the magnetic shunt alloy of the heating roller 20 reaches a temperature near the Curie temperature, a magnetic flux B generated by the induction heater 50 barely penetrates through the heating roller 20 and most of input power is consumed by the heating roller 20. Accordingly, the fixing device 10 is warmed up for a shortened time.

The area of the fixing nip N' formed while the fixing device 10 is warmed up is smaller than the area of the fixing nip N formed while the pressure roller 60 is pressed against the fixing roller 30 via the fixing belt 40 with increased pressure. Accordingly, a reduced amount of heat is conducted from the fixing belt 40 to the pressure roller 60 through the fixing nip N'. Consequently, the heating roller 20 heats the fixing belt 40 effectively, shortening a warm-up time further. In addition to a warm-up period, while no recording medium P is conveyed through the fixing device 10 or while the fixing device 10 is in an energy saver mode or the like, the aluminum member 21 and the heating roller 20 are positioned as shown in FIGS. 8 and 9, enhancing heating efficiency of the heating roller 20. According to this example embodiment, the aluminum member adjustment plate 81 contacts the core metal 63 of the pressure roller 60 and the aluminum member 21 directly. Alternatively, the aluminum member adjustment plate 81 may be connected to the core metal 63 of the pressure roller 60 and the aluminum member 21 indirectly. According to this example embodiment, the aluminum member 21 serving as a magnetic shield moves in the diametrical direction of the heating roller 20. Alternatively, the aluminum member 21 may move in a circumferential direction of the heating roller 20.

Incidentally, a fixing device may suffer from overheating as recording media of various sizes are conveyed over a fixing rotator (e.g., the fixing belt 40). For example, as a plurality of small recording media is conveyed over the fixing rotator continuously, a non-conveyance span of the fixing rotator where the small recording media are not conveyed may overheat because the small recording media do not draw heat from the non-conveyance span of the fixing rotator. To address this circumstance, a magnetic shunt material may be interposed between a heat generator and a magnetic shield. As the temperature of the magnetic shunt material reaches the Curie temperature or higher, a magnetic flux generated by an exciting device penetrates through the magnetic shunt material and is screened by the magnetic shield, thus suppressing overheating of the heat generator.

However, as the temperature of the magnetic shunt material approximates the Curie temperature while the fixing device is warmed up, an increased amount of magnetic fluxes penetrates through the magnetic shunt material and is screened by the magnetic shield, degrading heating efficiency of the fixing device and lengthening a warm-up time.

A description is provided of difference between the fixing device 10 and a comparative fixing device 10C.

Figure 11:
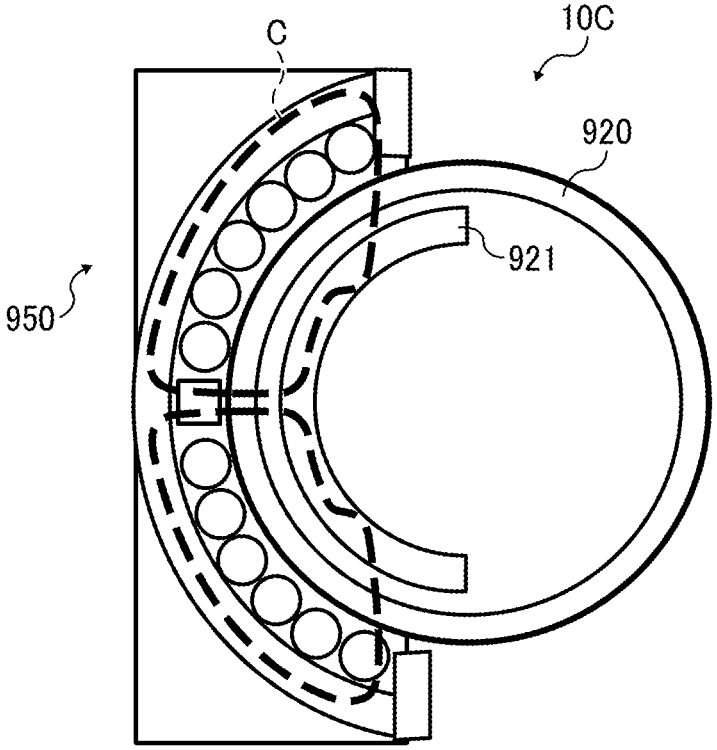
FIG. 11 is a partial schematic vertical sectional view of a comparative fixing device.

FIG. 11 is a partial schematic vertical sectional view of the comparative fixing device 10C. As shown in FIG. 11, the comparative fixing device 10C includes a stationary aluminum member 921. For example, while the recording medium P is conveyed through the comparative fixing device 10C and while the comparative fixing device 10C is warmed up, the stationary aluminum member 921 remains at a proximate position in proximity to a heating roller 920. Accordingly, as the temperature of the heating roller 920 approximates the Curie temperature during warm-up, a magnetic flux C generated by an induction heater 950 penetrates through the heating roller 920 and is screened by the aluminum member 921, lengthening a warm-up time.

A description is provided of a relation between time and temperature during warm-up of the fixing belt 40 depicted in FIG. 8.

Figure 12:
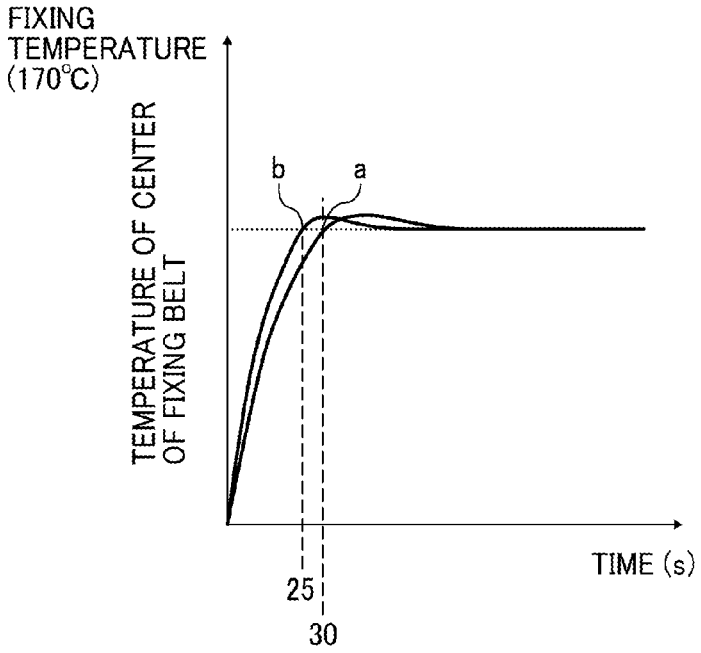
FIG. 12 is a graph showing a relation between time and temperature of a surface of the fixing belt shown in FIG. 3 during warm-up of the fixing device.

FIG. 12 is a graph showing the relation between time and temperature of a surface of the fixing belt 40 at a center in an axial direction thereof during warm-up of the fixing device 10. A temperature curve a shows change in temperature of a fixing belt incorporated in the comparative fixing device 10C depicted in FIG. 11 using the magnetic shunt alloy. A temperature curve b shows change in temperature of the fixing belt 40 incorporated in the fixing device 10. The Curie temperature of the magnetic shunt alloy is 200 degrees centigrade. A fixing temperature of the surface of the fixing belt 40 is 170 degrees centigrade.

With the comparative fixing device 10C, as the temperature of the fixing belt approximates the fixing temperature, the temperature of the fixing belt increases slowly. Consequently, a warm-up time is 30 seconds. It is because, as the temperature of the surface of the fixing belt approximates the Curie temperature, the fixing belt is heated ineffectively as described above. With the magnetic shunt alloy having the Curie temperature of 200 degrees centigrade, the temperature of the fixing belt increases slowly when the temperature of the fixing belt reaches about 100 degrees centigrade.

Conversely, with the fixing device 10, the temperature of the fixing belt 40 increases at a substantially constant velocity even when the temperature of the fixing belt 40 reaches a temperature near the fixing temperature. Consequently, a warm-up time is 25 seconds that is shorter by 5 seconds than the warm-up time of the comparative fixing device IOC shown by the temperature curve a. Accordingly, the temperature of the surface layer of the fixing belt 40 of the fixing device 10 increases more quickly than that of the fixing belt of the comparative fixing device 10C. Consequently, the fixing device 10 improves a warm-up property. As the warm-up time of the fixing device 10 is shortened, power consumption of the fixing device 10 is reduced.

As shown in FIG. 5, the cam 70 is supported by a cam shaft 71 connected to a motor M serving as a driver. As the motor M drives and rotates the cam 70 through the cam shaft 71, an identical driver, that is, the motor M, drives the aluminum member 21 and the cam 70. Accordingly, the aluminum member 21 and the cam 70 are driven with a reduced amount of power. The warm-up property of the fixing device 10 defines a warm-up time taken to heat the fixing belt 40 to the fixing temperature at which the fixing belt 40 fixes toner of the toner image T on the recording medium P. As the warm-up time is shortened, the image forming apparatus 1 incorporating the fixing device 10 improves usability for a user.

A description is provided of a relation between time and temperature during conveyance of the recording medium P over the fixing belt 40.

Figure 13:
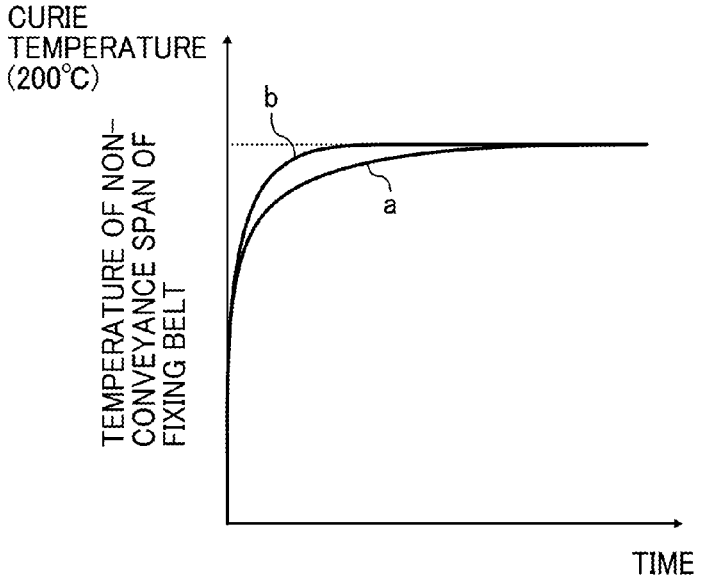
FIG. 13 is a graph showing a relation between time and temperature of the surface of the fixing belt shown in FIG. 3 in a non-conveyance span thereof where a recording medium is not conveyed during conveyance of the recording medium over the fixing belt.

FIG. 13 is a graph showing the relation between time and temperature of the surface of the fixing belt 40 in a non-conveyance span in the axial direction thereof where the recording medium P is not conveyed during conveyance of the recording medium P over the fixing belt 40. A temperature curve a shows change in temperature of the fixing belt incorporated in the comparative fixing device 10C depicted in FIG. 11 using the magnetic shunt alloy. A temperature curve b shows change in temperature of the fixing belt 40 incorporated in the fixing device 10.

With the fixing device 10, during conveyance of the recording medium P over the fixing belt 40, the aluminum member 21 is in proximity to the heating roller 20 like the aluminum member 921 in proximity to the heating roller 920 in the comparative fixing device 10C shown in FIG. 11. Accordingly, as shown in FIG. 7, the magnetic flux A penetrates through the magnetic shunt alloy of the heating roller 20 and is screened by the aluminum member 21. Hence, temperature increase of the fixing belt 40 stops at the Curie temperature of 200 degrees centigrade. Consequently, the aluminum member 21 of the fixing device 10 suppresses overheating of the fixing belt 40 more precisely than the aluminum member 921 of the comparative fixing device 10C.

The fixing device 10 includes the aluminum member adjustment plate 81 serving as the interlock that interlocks the cam 70 serving as a pressure adjuster that adjusts pressure exerted at the fixing nip N with the aluminum member 21 serving as the magnetic shield, thus moving the aluminum member 21 in accordance with movement of the cam 70.

Accordingly, the fixing device 10 shortens the warm-up time effectively with a simple structure without substantial modification of a typical pressurization mechanism of the comparative fixing device 10C that increases and decreases pressure exerted between the pressure roller 60 and the fixing belt 40. During warm-up, the fixing device 10 suppresses degradation in heating efficiency of the heating roller 20 due to adverse affection from the magnetic shunt material. As the pressure roller 60 is pressed against the fixing roller 30 via the fixing belt 40 with decreased pressure as shown in FIG. 8, the fixing nip N' having a decreased length in the recording medium conveyance direction D1 is produced and therefore a decreased amount of heat is conducted from the fixing belt 40 to the pressure roller 60 through the fixing nip N'. Accordingly, the induction heater 50 heats the heating roller 20 effectively, shortening the warm-up time of the fixing device 10.

The configuration of the fixing device 10 is not limited to that of the first example embodiment described above. For example, the fixing device 10 may include a flexible, endless fixing rotator and a pressurization member disposed opposite a nip formation member situated inside a loop formed by the fixing rotator via the fixing rotator. The pressurization member is pressed against the nip formation member via the fixing rotator to form a fixing nip between the fixing rotator and the pressurization member through which a recording medium P is conveyed under heat and pressure. The fixing rotator may include a heat generator incorporating a heat generation layer to generate heat by induction heating. Alternatively, the fixing device 10 may include a fixing roller serving as a fixing rotator or a fixing member and a pressure roller disposed opposite the fixing roller to form a fixing nip therebetween through which a recording medium is conveyed under heat and pressure. The fixing rotator may include a heat generator incorporating a heat generation layer to generate heat by induction heating.

With reference to FIGS. 14 to 19, a description is provided of a construction of a fixing device 105 according to a second example embodiment.

Identical reference numerals are assigned to components equivalent to the components incorporated in the fixing device 10 according to the first example embodiment shown in FIG. 2 and a detailed description of those components is omitted.

Figure 14:
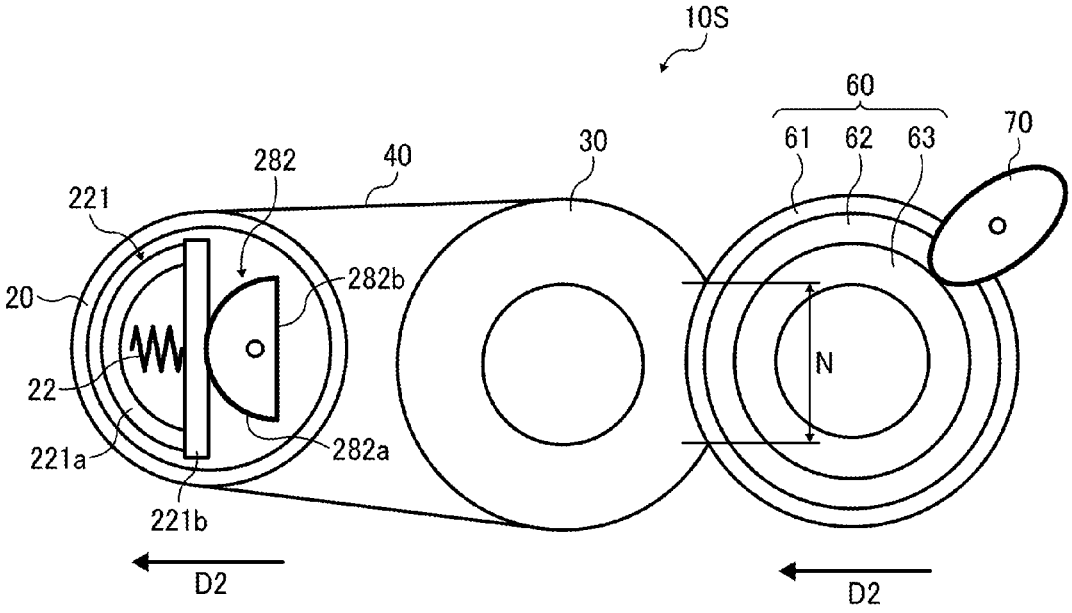
FIG. 14 is a schematic vertical sectional view of a fixing device according to a second example embodiment.

The fixing device 105 according to the second example embodiment includes a magnetic shield and an interlock that are different from those of the fixing device 10 according to the first example embodiment. FIG. 14 is a schematic vertical sectional view of the fixing device 10S. FIG. 16 is a partial schematic perspective view of the fixing device 10S. As shown in FIG. 14, the fixing device 105 includes an aluminum member 221 serving as a magnetic shield constructed of an arch 221 a (e.g., a semicylinder) and a planar bridge 221*b* bridging both bottoms of the arch 221*a*. An aluminum member adjustment cam 282 serving as a position adjuster contacts the aluminum member 221. Instead of the aluminum member adjustment plate 81 shown in FIG. 5, the fixing device 105 includes an aluminum member adjustment shaft assembly 82 serving as an interlock as shown in FIG. 15.

Figure 15:
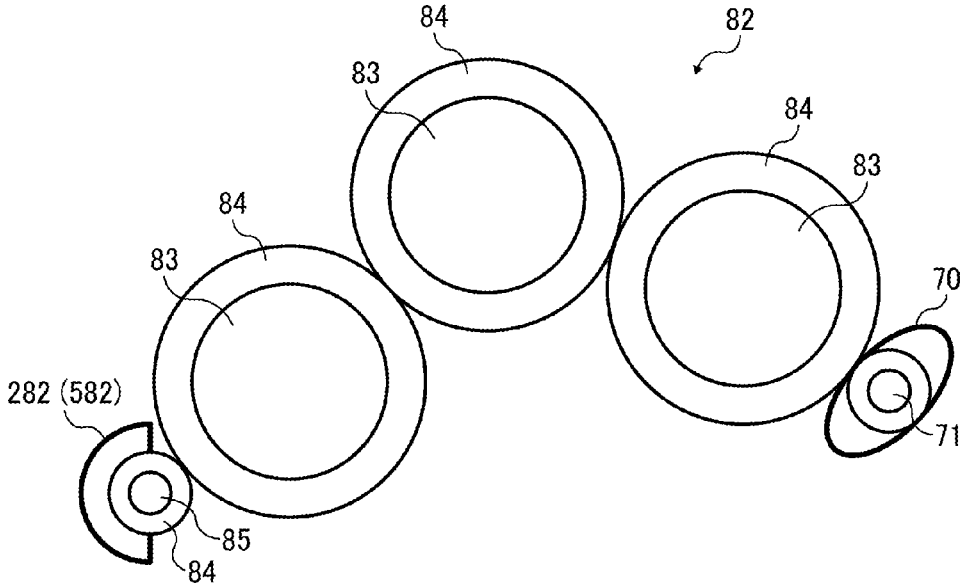
FIG. 15 is a schematic vertical sectional view of an aluminum member adjustment shaft assembly incorporated in the fixing device shown in FIG. 14.
Figure 16:
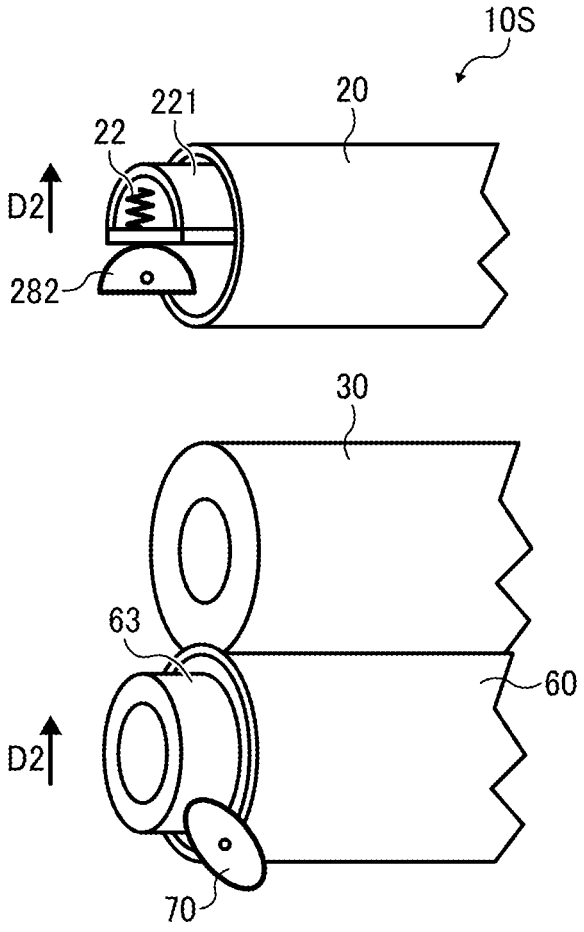
FIG. 16 is a partial schematic perspective view of the fixing device shown in FIG. 14.

FIG. 15 is a schematic vertical sectional view of the aluminum member adjustment shaft assembly 82. As shown in FIG. 15, the aluminum member adjustment shaft assembly 82, including shafts 83 and gears 84, is in connection or contact with the aluminum member adjustment cam 282 through an aluminum member adjustment cam shaft 85 that supports the aluminum member adjustment cam 282 and in connection or contact with the cam 70 through the cam shaft 71 that supports the cam 70. The aluminum member adjustment shaft assembly 82 interlocks the cam 70 with the aluminum member adjustment cam 282 to move or rotate the aluminum member adjustment cam 282 in accordance with rotation of the cam 70.

The aluminum member adjustment cam 282, as it rotates, reversibly lifts the aluminum member 221 to move the aluminum member 221 toward the heating roller 20 and lowers the aluminum member 221 to move the aluminum member 221 away from the heating roller 20. The aluminum member adjustment cam 282 is semicylindrical. As an arch face 282*a*, that is, an outer circumferential face, of the aluminum member adjustment cam 282 contacts the aluminum member 221, the aluminum member 221 is at a proximate position in proximity to the heating roller 20. Conversely, as a planar face 282*b* of the aluminum member adjustment cam 282 contacts the aluminum member 221, the aluminum member 221 is at a remote position being remote from the heating roller 20.

FIGS. 14 and 16 illustrate the position of the components of the fixing device 10S as the pressure roller 60 is pressed against the fixing roller 30 via the fixing belt 40 to convey the recording medium P through the fixing nip N. FIG. 14 is a sectional view of the fixing device 10S. FIG. 16 is a perspective view of the fixing device 105 illustrating one lateral end of the heating roller 20, the fixing roller 30, and the pressure roller 60 in the axial direction thereof FIG. 16 does not illustrate the fixing belt 40.

As the cam 70 rotates and moves the pressure roller 60 toward the fixing belt 40 in the pressurization direction D2, the pressure roller 60 is pressed against the fixing roller 30 via the fixing belt 40 with increased pressure, forming the fixing nip N between the fixing belt 40 and the pressure roller 60. As the cam 70 and the aluminum member adjustment cam 282 rotate via interlocking of the aluminum member adjustment shaft assembly 82, the aluminum member 221 contacted by the aluminum member adjustment cam 282 also moves in the pressurization direction D2. The aluminum member 221 moves to the proximate position in proximity to the heating roller 20 where the first interval in a range of from about 0.4 mm to about 2.0 mm is provided between the aluminum member 221 and the heating roller 20. A magnetic flux generated by the induction heater 50 penetrates through the magnetic shunt alloy of the heating roller 20 at the overheating portion of the fixing belt 40 where the recording medium P is not conveyed and is screened by the aluminum member 221 situated inside the heating roller 20. Accordingly, overheating of the fixing belt 40 is prevented.

Figure 17:
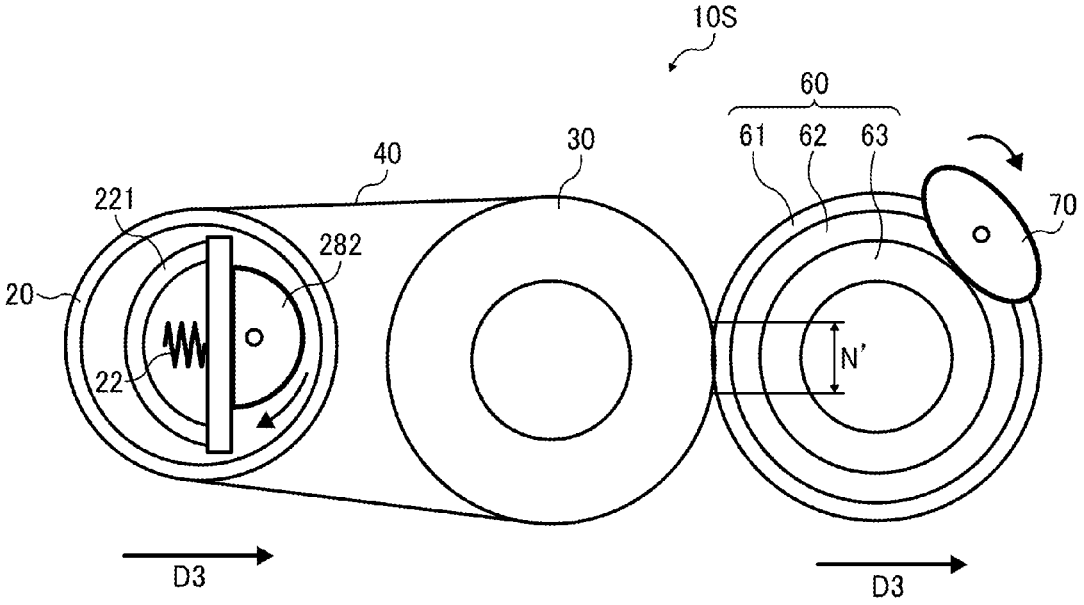
FIG. 17 is a schematic vertical sectional view of the fixing device shown in FIG. 14 as the pressure roller is pressed against the fixing belt with decreased pressure.
Figure 18:
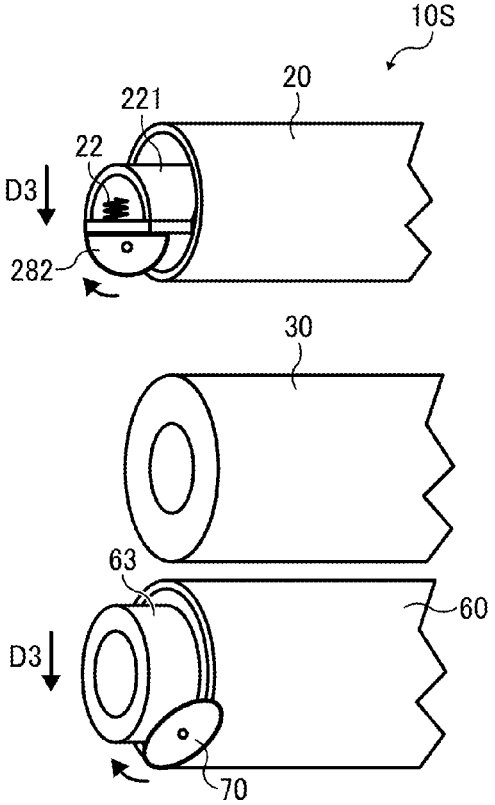
FIG. 18 is a partial schematic perspective view of the fixing device shown in FIG. 17.

FIGS. 17 and 18 illustrate the position of the components of the fixing device 10S as the pressure roller 60 releases pressure exerted to the fixing roller 30 via the fixing belt 40 to warm up the fixing device 10S. FIG. 17 is a schematic vertical sectional view of the fixing device 10S. FIG. 18 is a partial schematic perspective view of the fixing device 10S illustrating one lateral end of the heating roller 20, the fixing roller 30, and the pressure roller 60 in the axial direction thereof. FIG. 18 does not illustrate the fixing belt 40.

As the cam 70 rotates and moves the pressure roller 60 away from the fixing belt 40 in the depressurization direction D3, the pressure roller 60 is pressed against the fixing roller 30 via the fixing belt 40 with decreased pressure or no pressure, forming the fixing nip N' between the fixing belt 40 and the pressure roller 60. According to this example embodiment, even when the pressure roller 60 is pressed against the fixing roller 30 via the fixing belt 40 with decreased pressure, the fixing nip N' is formed between the fixing belt 40 and the pressure roller 60. Alternatively, the pressure roller 60 may be isolated from the fixing belt 40, forming no fixing nip therebetween.

As the cam 70 and the aluminum member adjustment cam 282 rotate via interlocking of the aluminum member adjustment shaft assembly 82, the aluminum member 221 contacted by the aluminum member adjustment cam 282 also moves in the depressurization direction D3. The aluminum member 221 moves to the remote position being remote from the heating roller 20 where the second interval greater than the first interval created as the fixing nip N is formed between the fixing belt 40 and the pressure roller 60 as shown in FIG. 14 by a distance in a range of from about 2.0 mm to about 5.0 mm provided between the aluminum member 221 and the heating roller 20. As shown in FIG. 17, since a sufficient interval is provided between the heating roller 20 and the aluminum member 221, even when the temperature of the magnetic shunt alloy of the heating roller 20 reaches a temperature near the Curie temperature, a magnetic flux generated by the induction heater 50 barely penetrates through the heating roller 20 and most of input power is consumed by the heating roller 20. Accordingly, the fixing device 10S is warmed up for a shortened time. In addition to a warm-up period, while no recording medium P is conveyed through the fixing device 10S or while the fixing device 10S is in the energy saver mode or the like, the aluminum member 221 and the heating roller 20 are positioned as shown in FIGS. 17 and 18, enhancing heating efficiency of the heating roller 20.

Figure 19:
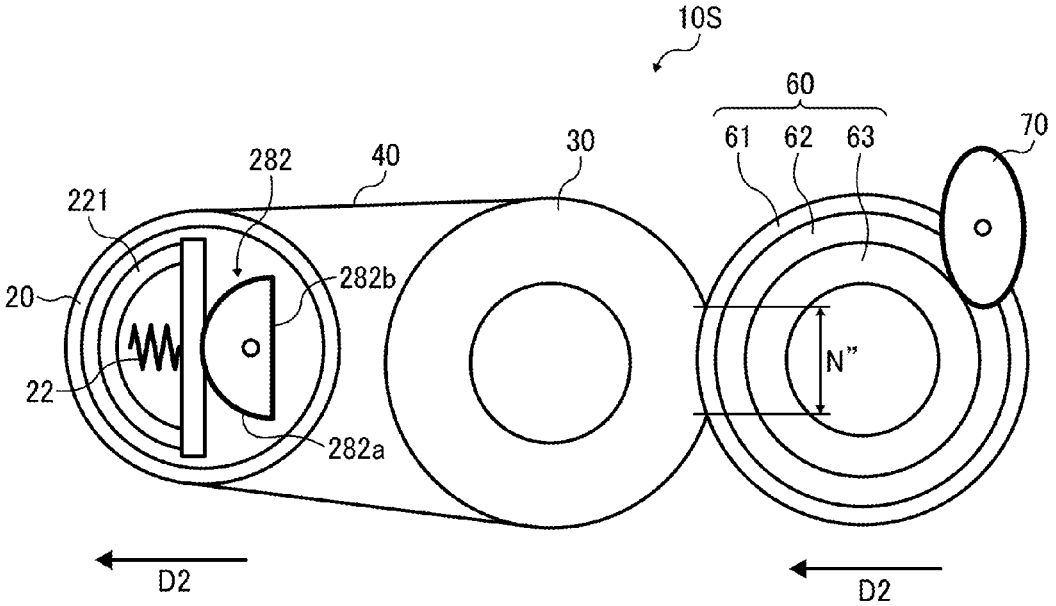
FIG. 19 is a schematic vertical sectional view of the fixing device shown in FIG. 14 as the pressure roller is pressed against the fixing belt with intermediate pressure.

FIG. 19 is a schematic vertical sectional view of the fixing device 10S. As shown in FIG. 19, the cam 70, as it rotates, adjusts the position of the pressure roller 60, pressing the pressure roller 60 against the fixing roller 30 via the fixing belt 40 with intermediate pressure intermediate between increased pressure and decreased pressure. For example, as the pressure roller 60 is pressed against the fixing roller 30 via the fixing belt 40 with intermediate pressure, that is intermediate between increased pressure to form the fixing nip N depicted in FIG. 14 and decreased pressure to form the fixing nip N' depicted in FIGS. 17, to form a fixing nip N" between the fixing belt 40 and the pressure roller 60, the area of the fixing nip N" is intermediate between the area of the fixing nip N and the area of the fixing nip N'. The aluminum member 221 contacts the arch face 282*a* of the aluminum member adjustment cam 282. While the aluminum member 221 contacts the arch face 282*a* of the aluminum member adjustment cam 282 for a given time, the aluminum member 221 is at the proximate position in proximity to the heating roller 20 like the aluminum member 221 is at the proximate position while the fixing nips N and N' are formed by increased pressure and decreased pressure exerted by the pressure roller 60, respectively. Thus, even after a plurality of recording media P is conveyed over the fixing belt 40 continuously, the fixing belt 40 is immune from overheating in the non-conveyance span thereof where the recording media P are not conveyed and therefore do not draw heat from the fixing belt 40. The configuration of the aluminum member adjustment cam 282 is not limited to that of this example embodiment. According to the second example embodiment, the aluminum member 221 moves in the diametrical direction of the heating roller 20. Alternatively, the aluminum member 221 may move in the circumferential direction of the heating roller 20.

With the construction of the fixing device 10S described above, the pressure roller 60 is pressed against the fixing roller 30 via the fixing belt 40 with three levels of pressure, that is, increased pressure to form the fixing nip N, decreased pressure to form the fixing nip N', and intermediate pressure to form the fixing nip N", respectively. Accordingly, while a plurality of recording media P is conveyed through the fixing nip N or N" continuously, the aluminum member 221 is spaced apart from the heating roller 20 with a constant interval therebetween, regardless of increased pressure or intermediate pressure exerted at the fixing nip N or N". Thus, pressure exerted at the fixing nips N and N" is switched between two levels of pressure, that is, increased pressure and intermediate pressure. Consequently, pressure exerted between the pressure roller 60 and the fixing belt 40 and the temperature of the fixing belt 40 are controlled according to the type of the recording medium P and the type of the toner image T formed on the recording medium P, resulting in formation of the high quality toner image T fixed on the recording medium P.

Figure 20:
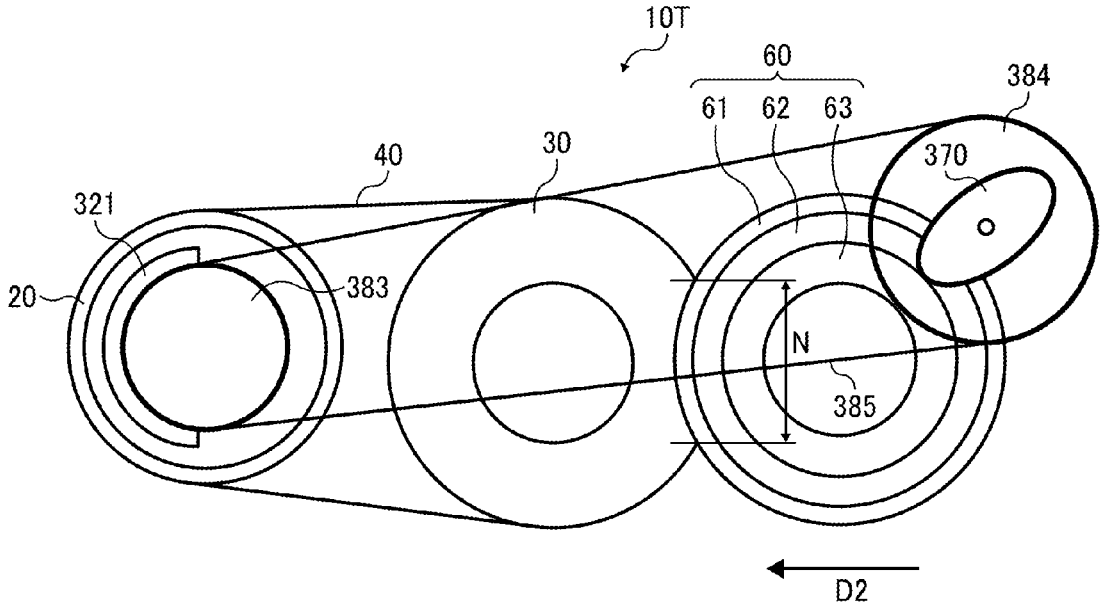
FIG. 20 is a schematic vertical sectional view of a fixing device according to a third example embodiment.
Figure 21:
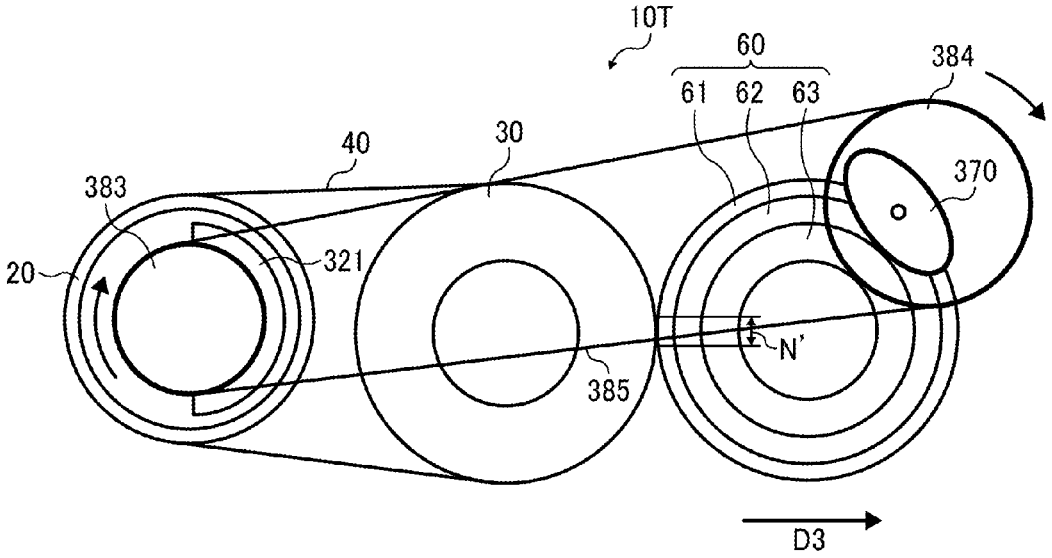
FIG. 21 is a schematic vertical sectional view of the fixing device shown in FIG. 20 as the pressure roller releases pressure exerted to the fixing belt.

With reference to FIGS. 20 and 21, a description is provided of a construction of a fixing device 10T according to a third example embodiment.

Identical reference numerals are assigned to components equivalent to the components incorporated in the fixing device 10 according to the first example embodiment shown in FIG. 2 and a detailed description of those components is omitted.

The fixing device 10T according to the third example embodiment includes a magnetic shield and an interlock that are different from those of the fixing device 10 according to the first example embodiment. FIG. 20 is a schematic vertical sectional view of the fixing device 10T. As shown in FIG. 20, the fixing device 10T includes a semicylindrical or arcuate aluminum member 321. The aluminum member 321 is connected to an aluminum member side pulley 383 serving as a position adjuster. A cam 370 is connected to or attached to a cam side pulley 384. A pulley belt 385 serving as an interlock is stretched taut across the aluminum member side pulley 383 and the cam side pulley 384. The aluminum member 321 and the cam 370 are rotatable through interlocking by the pulley belt 385.

FIG. 20 illustrates the position of the components of the fixing device 10T as the pressure roller 60 is pressed against the fixing roller 30 via the fixing belt 40 to convey the recording medium P through the fixing nip N. As the cam 370 rotates and moves the pressure roller 60 toward the fixing belt 40 in the pressurization direction D2, the pressure roller 60 is pressed against the fixing roller 30 via the fixing belt 40 with increased pressure, forming the fixing nip N between the fixing belt 40 and the pressure roller 60. As the cam 370 and the aluminum member 321 rotate through interlocking of the pulley belt 385, the aluminum member 321 rotates in the circumferential direction of the heating roller 20 by 180 degrees. The aluminum member 321 moves to the proximate position in proximity to the heating roller 20 where the first interval in a range of from about 0.4 mm to about 2.0 mm is provided between the aluminum member 321 and the heating roller 20. A magnetic flux generated by the induction heater 50 penetrates through the magnetic shunt alloy of the heating roller 20 at the overheating portion of the fixing belt 40 where the recording medium P is not conveyed and is screened by the aluminum member 321 situated inside the heating roller 20. Accordingly, overheating of the fixing belt 40 is prevented.

FIG. 21 is a schematic vertical sectional view of the fixing device 10T, illustrating the position of the components of the fixing device 10T as the pressure roller 60 releases pressure exerted to the fixing roller 30 via the fixing belt 40 to warm up the fixing device 10T. As the cam 370 rotates and moves the pressure roller 60 away from the fixing belt 40 in the depressurization direction D3, the pressure roller 60 is pressed against the fixing roller 30 via the fixing belt 40 with decreased pressure, forming the fixing nip N' between the fixing belt 40 and the pressure roller 60. According to this example embodiment, even when the pressure roller 60 is pressed against the fixing roller 30 via the fixing belt 40 with decreased pressure, the fixing nip N' is formed between the fixing belt 40 and the pressure roller 60. Alternatively, the pressure roller 60 may be isolated from the fixing belt 40, forming no fixing nip therebetween.

As the cam 370 and the aluminum member 321 rotate through interlocking of the pulley belt 385, the aluminum member 321 rotates in the circumferential direction of the heating roller 20 by 180 degrees. The aluminum member 321 moves to the remote position being remote from the heating roller 20 where the second interval greater than the first interval created as the fixing nip N is formed between the fixing belt 40 and the pressure roller 60 as shown in FIG. 20 by a distance in a range of from about 10.0 mm to about 20.0 mm provided between the aluminum member 321 and the heating roller 20. As shown in FIG. 21, since a sufficient interval is provided between the heating roller 20 and the aluminum member 321, even when the temperature of the magnetic shunt alloy of the heating roller 20 reaches a temperature near the Curie temperature, a magnetic flux generated by the induction heater 50 barely penetrates through the heating roller 20 and most of input power is consumed by the heating roller 20. Accordingly, the fixing device 10T is warmed up for a shortened time. In addition to a warm-up period, while no recording medium P is conveyed through the fixing device 10T or while the fixing device 10T is in the energy saver mode or the like, the aluminum member 321 and the heating roller 20 are positioned as shown in FIG. 21, enhancing heating efficiency of the heating roller 20. According to the third example embodiment, the aluminum member 321 moves in the circumferential direction of the heating roller 20. Alternatively, the aluminum member 321 may move in the diametrical direction of the heating roller 20.

Like the fixing device 10S according to the second example embodiment depicted in FIGS. 14 to 19, the fixing device 10T according to the third example embodiment may also adjust pressure exerted between the pressure roller 60 and the fixing belt 40 in three or more levels, that is, increased pressure, intermediate pressure, and decreased pressure. For example, two types of the aluminum member side pulley 383 used to produce increased pressure and intermediate pressure, respectively, are selectively actuated by a clutch or the like so that the aluminum member 321 is situated at the proximate position in proximity to the heating roller 20 as the pressure roller 60 is pressed against the fixing roller 30 via the fixing belt 40 with increased pressure or intermediate pressure.

With reference to FIGS. 22 to 28, a description is provided of a construction of a fixing device 10U according to a fourth example embodiment.

Figure 22:
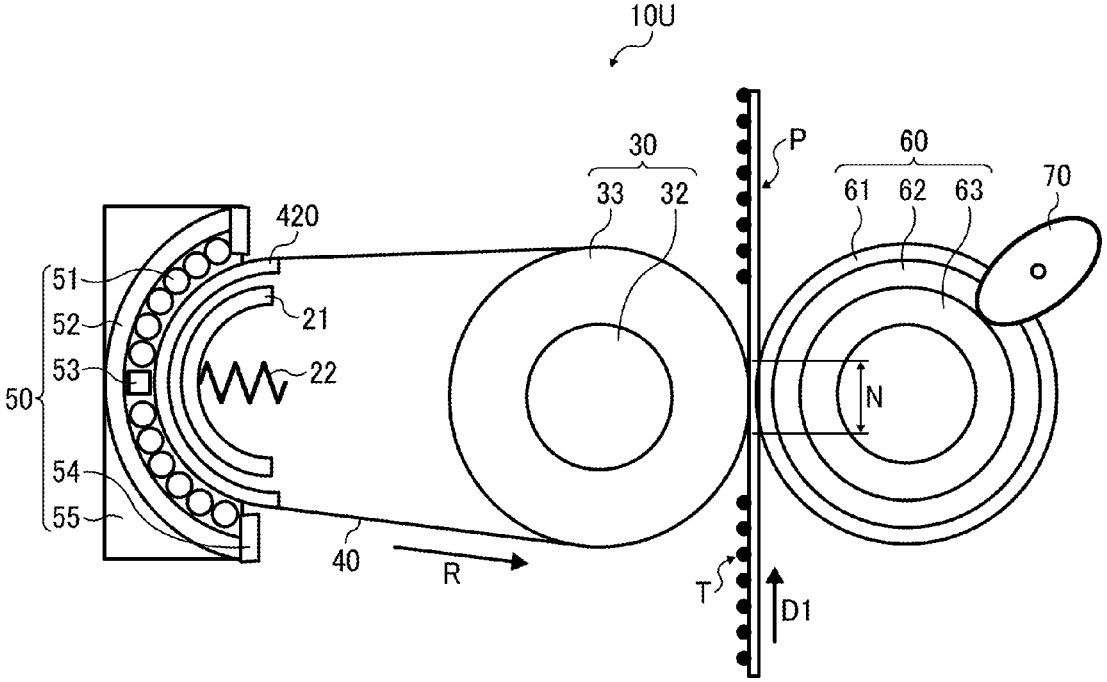
FIG. 22 is a schematic vertical sectional view of a fixing device according to a fourth example embodiment.

Identical reference numerals are assigned to components equivalent to the components incorporated in the fixing device 10 according to the first example embodiment shown in FIG. 2 and a detailed description of those components is omitted. FIG. 22 is a schematic vertical sectional view of the fixing device 10U. As shown in FIG. 22, the fixing device 10U includes a heating pad 420 serving as a heat generator instead of the heating roller 20 of the fixing device 10 shown in FIG. 2.

The heating pad 420, made of a magnetic shunt alloy as a magnetic shunt material, is a semicylinder or arch projecting toward the induction heater 50. The fixing belt 40 is stretched taut across the heating pad 420 and the fixing roller 30. The heating pad 420 is stationarily disposed opposite the induction heater 50 and the semicylindrical aluminum member 21. The heating pad 420 may be manufactured by processing a magnetic shunt alloy material into a semicylinder by pressing or the like or into an arch by bending. Alternatively, the surface magnetic shunt alloy layer may be coated with a copper layer, as a heat generation layer, having a thickness in a range of from about 3 micrometers to about 15 micrometers. The copper layer coating the magnetic shunt alloy layer enhances heat generation efficiency of the heat generation layer. The surface copper layer may be coated with nickel to prevent rust. The heating pad 420 may have shapes other than the semicylinder and the arch.

The heating pad 420 is a non-rotation body that is not rotatable. Hence, as the fixing belt 40 rotates in the rotation direction R, the fixing belt 40 slides over an outer circumferential face of the heating pad 420. The fixing belt 40 is heated by the heating pad 420 heated by the induction heater 50. As a recording medium P bearing a toner image T is conveyed through the fixing nip N, the fixing belt 40 and the pressure roller 60 apply heat and pressure to the toner image T on the recording medium P, fixing the toner image T on the recording medium P.

The aluminum member 21 and the compression spring 22 are disposed opposite an inner circumferential surface of the heating pad 420. As the compression spring 22 expands and contracts, the aluminum member 21 moves in a direction in which it comes closer to the heating pad 420 and a direction in which it separates away from the heating pad 420. On the other hand, the cam 70 contacting the core metal 63 of the pressure roller 60 is driven and rotated to change pressure exerted to the core metal 63. The cam 70 lifts the pressure roller 60 or moves the pressure roller 60 toward the fixing belt 40 to press the pressure roller 60 against the fixing roller 30 via the fixing belt 40 at the fixing nip N with increased pressure. Conversely, the cam 70 lowers the pressure roller 60 or moves the pressure roller 60 away from the fixing belt 40 to release pressure between the pressure roller 60 and the fixing belt 40 at the fixing nip N.

Figure 23:
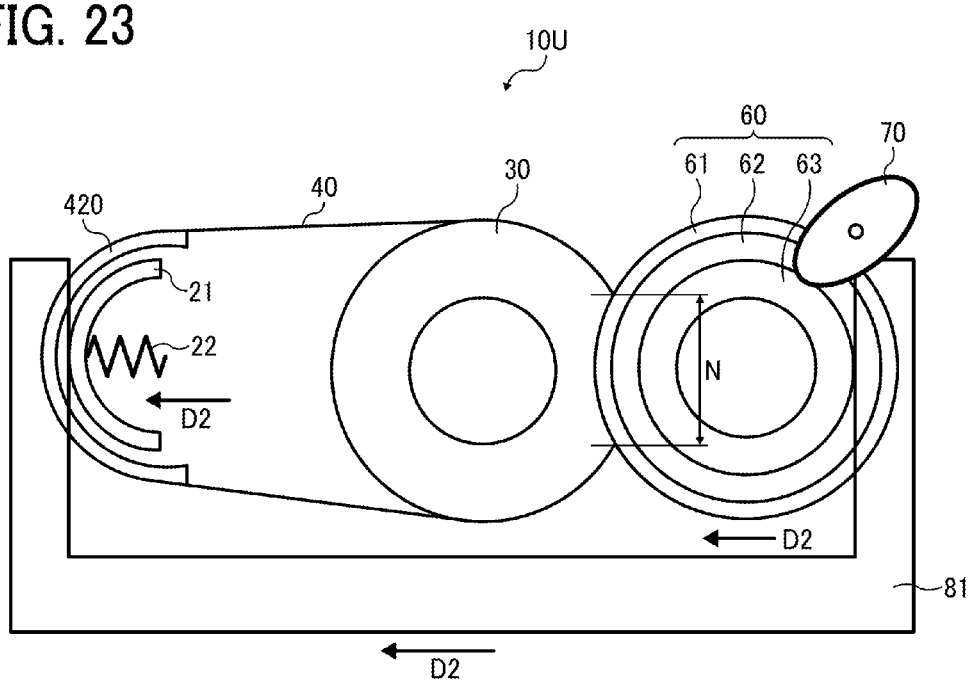
FIG. 23 is a schematic vertical sectional view of the fixing device shown in FIG. 22 as the pressure roller is pressed against the fixing belt with increased pressure.
Figure 24:
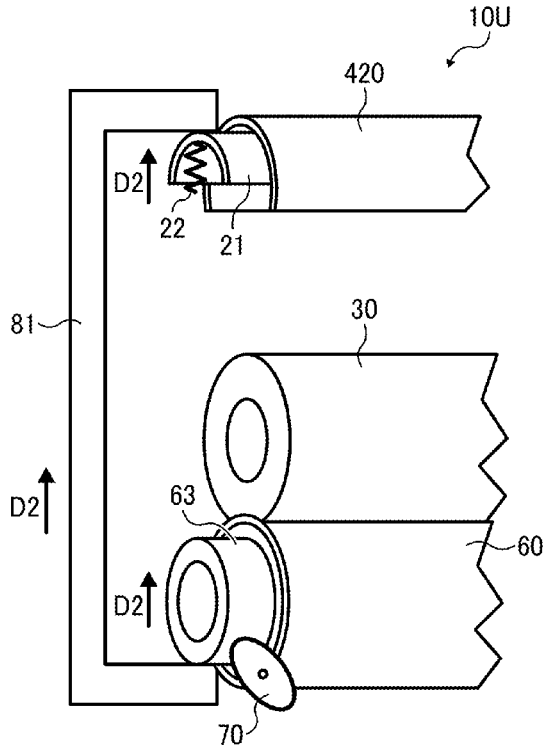
FIG. 24 is a partial schematic perspective view of the fixing device shown in FIG. 23.

FIG. 23 is a schematic vertical sectional view of the fixing device 10U. FIG. 24 is a partial schematic perspective view of the fixing device 10U. As shown in FIG. 23, the aluminum member adjustment plate 81 serving as an interlock is in contact or connection with the aluminum member 21 and the core metal 63 of the pressure roller 60 and moves in accordance with movement of the core metal 63 of the pressure roller 60, thus moving the aluminum member 21 in accordance with movement of the pressure roller 60. Although FIG. 23 illustrates the aluminum member adjustment plate 81 overlapping components of the fixing device 10U other than the aluminum member 21 and the pressure roller 60, the aluminum member adjustment plate 81 contacts the aluminum member 21 and the lateral end of the core metal 63 in the axial direction of the pressure roller 60 and does not contact the components of the fixing device 10U other than the aluminum member 21 and the core metal 63 of the pressure roller 60 as shown in FIG. 24. The aluminum member adjustment plate 81 is made of metal such as stainless steel.

FIGS. 23 and 24 illustrate the position of the components of the fixing device 10U as the pressure roller 60 is pressed against the fixing roller 30 via the fixing belt 40 to convey the recording medium P through the fixing nip N. FIG. 23 is a sectional view of the fixing device 10U. FIG. 24 is a perspective view of the fixing device IOU illustrating one lateral end of the heating pad 420, the fixing roller 30, and the pressure roller 60 in the axial direction thereof. FIG. 24 does not illustrate the fixing belt 40.

As the cam 70 rotates and moves the pressure roller 60 toward the fixing belt 40 in the pressurization direction D2, the pressure roller 60 is pressed against the fixing roller 30 via the fixing belt 40 with increased pressure, forming the fixing nip N between the fixing belt 40 and the pressure roller 60. In accordance with movement of the pressure roller 60, the core metal 63 of the pressure roller 60, the aluminum member 21, and the aluminum member adjustment plate 81 interlocking the core metal 63 with the aluminum member 21 also move in the pressurization direction D2. The aluminum member 21 moves leftward in FIG. 23 in a radius-of-curvature direction of the heating pad 420 corresponding to the pressurization direction D2 of the pressure roller 60 to the proximate position in proximity to the heating pad 420 where the first interval in a range of from about 0.4 mm to about 2.0 mm is provided between the aluminum member 21 and the heating pad 420.

Figure 25:
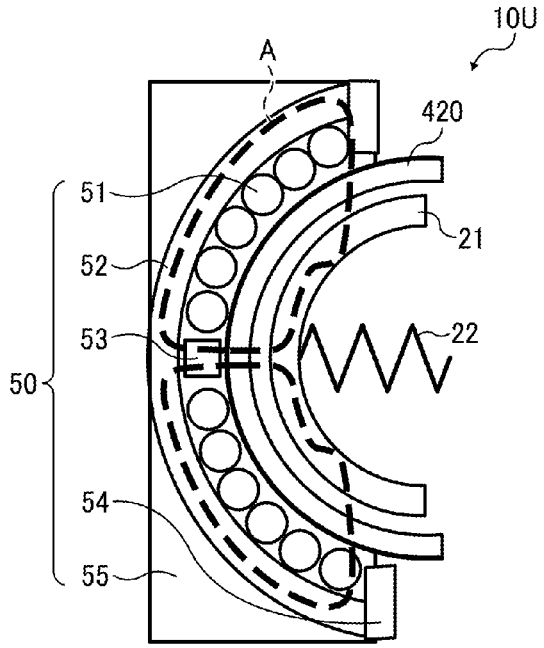
FIG. 25 is a vertical sectional view of a heating pad and the induction heater incorporated in the fixing device shown in FIG. 23.

FIG. 25 is a vertical sectional view of the heating pad 420 and the induction heater 50. As shown in FIG. 25, a magnetic flux A generated by the induction heater 50 penetrates through the magnetic shunt alloy of the heating pad 420 at the overheating portion of the fixing belt 40 where the recording medium P is not conveyed and is screened by the aluminum member 21 situated inside the heating pad 420. Accordingly, overheating of the fixing belt 40 is prevented.

Figure 26:
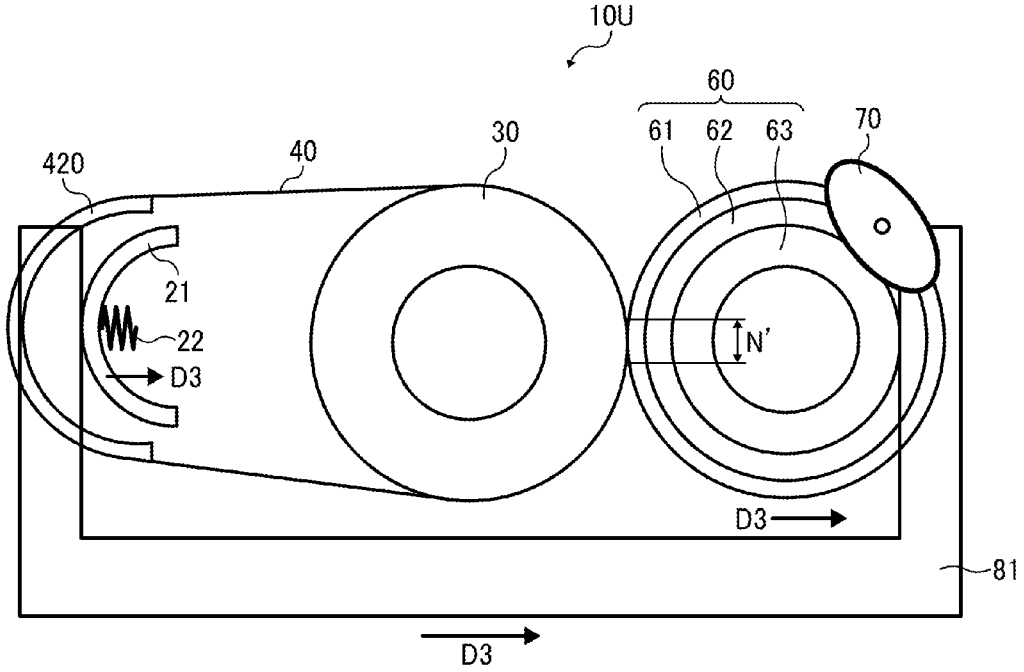
FIG. 26 is a schematic vertical sectional view of the fixing device shown in FIG. 23 as the pressure roller releases pressure exerted to the fixing belt.
Figure 27:
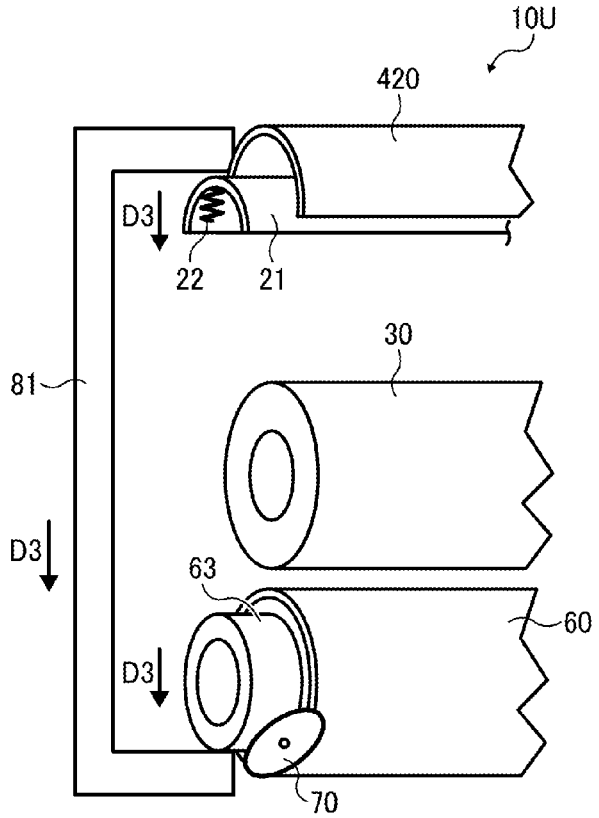
FIG. 27 is a partial schematic perspective view of the fixing device shown in FIG. 26.

FIGS. 26 and 27 illustrate the position of the components of the fixing device 10U as the pressure roller 60 releases pressure exerted to the fixing roller 30 via the fixing belt 40 to warm up the fixing device 10U. FIG. 26 is a schematic vertical sectional view of the fixing device 10U. FIG. 27 is a partial schematic perspective view of the fixing device 10U illustrating one lateral end of the heating pad 420, the fixing roller 30, and the pressure roller 60 in the axial direction thereof FIG. 27 does not illustrate the fixing belt 40.

As the cam 70 rotates and moves the pressure roller 60 away from the fixing belt 40 in the depressurization direction D3, the pressure roller 60 is pressed against the fixing roller 30 via the fixing belt 40 with decreased pressure or no pressure, forming the fixing nip N' between the fixing belt 40 and the pressure roller 60. According to this example embodiment, even when the pressure roller 60 is pressed against the fixing roller 30 via the fixing belt 40 with decreased pressure, the fixing nip N' is formed between the fixing belt 40 and the pressure roller 60. Alternatively, the pressure roller 60 may be isolated from the fixing belt 40, forming no fixing nip therebetween.

In accordance with movement of the pressure roller 60, the core metal 63 of the pressure roller 60, the aluminum member 21, and the aluminum member adjustment plate 81 interlocking the core metal 63 with the aluminum member 21 also move in the depressurization direction D3. The aluminum member 21 moves rightward in FIG. 26 in the radius-of-curvature direction of the heating pad 420 corresponding to the depressurization direction D3 of the pressure roller 60 to the remote position being remote from the heating pad 420 where the second interval greater than the first interval created as the fixing nip N is formed between the fixing belt 40 and the pressure roller 60 as shown in FIG. 23 by a distance in a range of from about 3.0 mm to about 5.0 mm provided between the aluminum member 21 and the heating pad 420.

Figure 28:
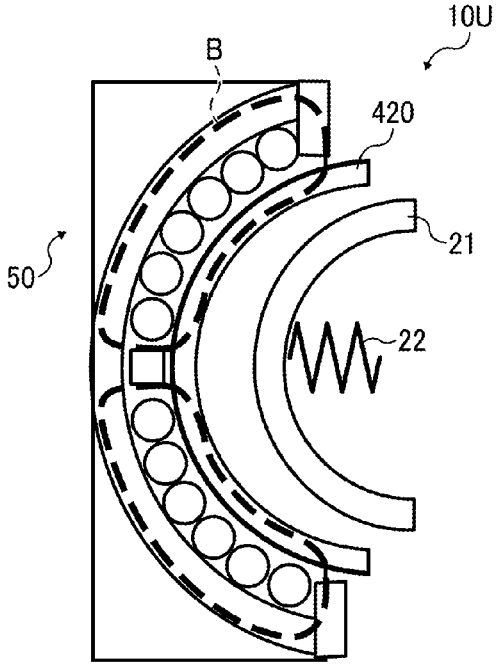
FIG. 28 is a vertical sectional view of the heating pad and the induction heater incorporated in the fixing device shown in FIG. 26.

FIG. 28 is a vertical sectional view of the heating pad 420 and the induction heater 50. As shown in FIG. 28, since a sufficient interval is provided between the heating pad 420 and the aluminum member 21, even when the temperature of the magnetic shunt alloy of the heating pad 420 reaches a temperature near the Curie temperature, a magnetic flux B generated by the induction heater 50 barely penetrates through the heating pad 420 and most of input power is consumed by the heating pad 420. Accordingly, the fixing device 10U is warmed up for a shortened time.

The area of the fixing nip N' formed while the fixing device 10U is warmed up is smaller than the area of the fixing nip N formed while the pressure roller 60 is pressed against the fixing roller 30 via the fixing belt 40 with increased pressure. Accordingly, a reduced amount of heat is conducted from the fixing belt 40 to the pressure roller 60 through the fixing nip N'. Consequently, the heating pad 420 heats the fixing belt 40 effectively, shortening a warm-up time further. In addition to a warm-up period, while no recording medium P is conveyed through the fixing device 10U or while the fixing device IOU is in the energy saver mode or the like, the aluminum member 21 and the heating pad 420 are positioned as shown in FIGS. 26 and 27, enhancing heating efficiency of the heating pad 420. According to this example embodiment, the aluminum member adjustment plate 81 contacts the core metal 63 of the pressure roller 60 and the aluminum member 21 directly. Alternatively, the aluminum member adjustment plate 81 may be connected to the core metal 63 of the pressure roller 60 and the aluminum member 21 indirectly. According to this example embodiment, the aluminum member 21 serving as a magnetic shield moves in the radius-of-curvature direction of the heating pad 420. Alternatively, the aluminum member 21 may move in a circumferential direction of the heating pad 420.

In addition to the advantages of the fixing device 10 according to the first example embodiment, the fixing device IOU according to the fourth example embodiment achieves advantages of improving installation and maintenance with the simple construction of the interlock, the pressure adjuster, and the like. For example, as shown in FIG. 2, the fixing device 10 according to the first example embodiment includes the aluminum member 21 and the compression spring 22 situated inside the heating roller 20. The aluminum member adjustment plate 81 serving as the interlock moves the aluminum member 21 in accordance with movement of the pressure roller 60.

Contrarily, as shown in FIG. 22, the fixing device 10U according to the fourth example embodiment includes the heating pad 420 instead of the heating roller 20 depicted in FIG. 2. The aluminum member 21 is substantially in parallel with the heating pad 420. As shown in FIGS. 23 and 26, the aluminum member adjustment plate 81 serving as the interlock moves the aluminum member 21 in accordance with movement of the pressure roller 60. The simple parts, that is, the aluminum member adjustment plate 81 serving as the interlock and the cam 70 serving as the pressure adjuster, improve their installation inside the fixing device 10U and maintenance of the fixing device 10U. Additionally, the heating pad 420 serving as a heat generator has a decreased thermal capacity, shortening a warm-up time and reducing power consumption.

Since the heating pad 420 is semicylindrical or arcuate, as the fixing belt 40 slides over the outer circumferential face of the heating pad 420, the heating pad 420 reduces friction therebetween and thereby reduces abrasion of the fixing belt 40. Additionally, the heating pad 420 decreases torque of a driver that drives the fixing belt 40 and reduces noise generated by the fixing device 10U.

Alternatively, the outer circumferential face of the heating pad 420 over which the fixing belt 40 slides may be made of a material having a decreased friction coefficient. A lubricant such as silicone oil and fluorine grease may be applied between the heating pad 420 and the fixing belt 40. Thus, as the fixing belt 40 slides over the heating pad 420, abrasion of the fixing belt 40 is reduced.

The fixing device 10U employing the heating pad 420 instead of the heating roller 20 decreases an amount of the magnetic shunt alloy. The heating pad 420 is manufactured readily compared to the heating roller 20, reducing manufacturing costs.

With reference to FIGS. 29 to 33, a description is provided of a construction of a fixing device 10V according to a fifth example embodiment.

Identical reference numerals are assigned to components equivalent to the components incorporated in the fixing device 10U according to the fourth example embodiment shown in FIG. 23 and a detailed description of those components is omitted.

Figure 29:
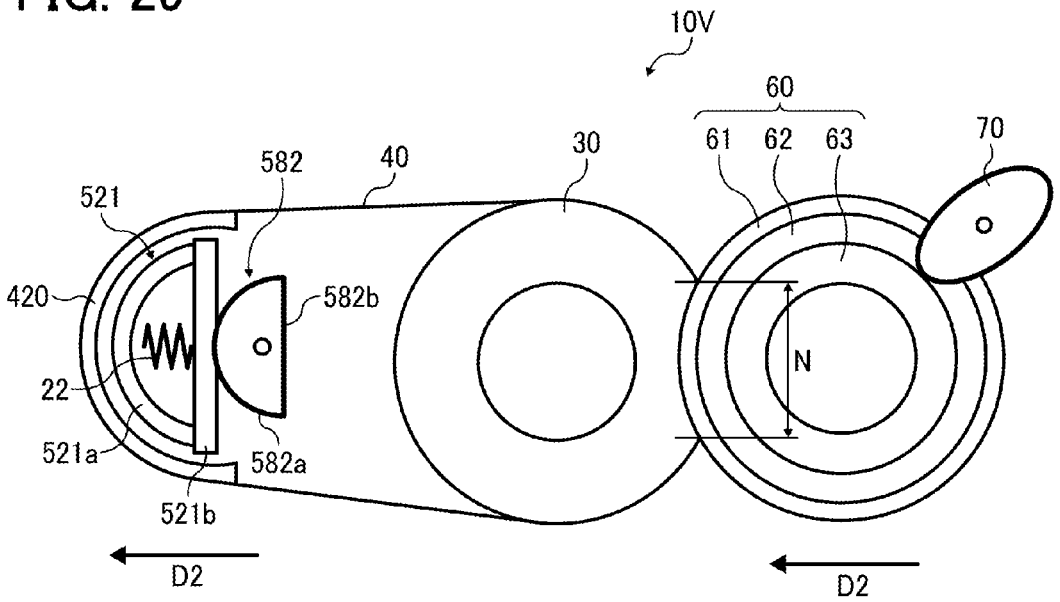
FIG. 29 is a schematic vertical sectional view of a fixing device according to a fifth example embodiment.
Figure 30:
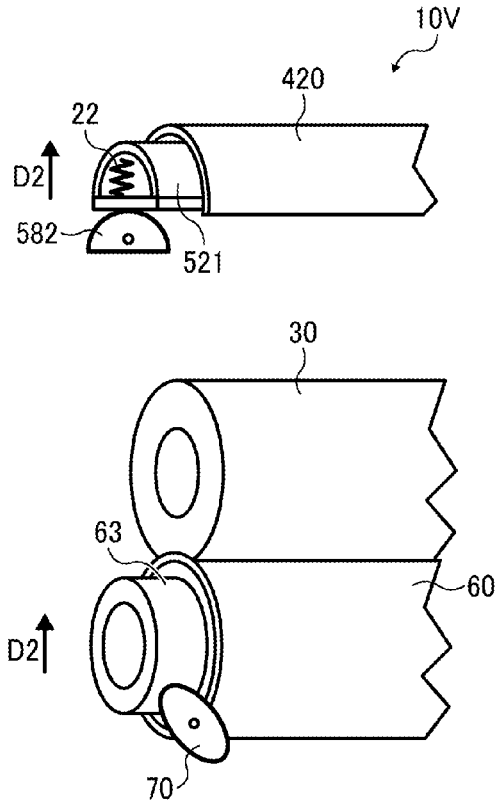
FIG. 30 is a partial schematic perspective view of the fixing device shown in FIG. 29.

The fixing device 10V according to the fifth example embodiment includes a magnetic shield and an interlock that are different from those of the fixing device 10U according to the fourth example embodiment. FIG. 29 is a schematic vertical sectional view of the fixing device 10V FIG. 30 is a partial schematic perspective view of the fixing device 10V. As shown in FIG. 29, the fixing device 10V includes an aluminum member 521 serving as a magnetic shield constructed of an arch 521*a* (e.g., a semicylinder) and a planar bridge 521*b* bridging both bottoms of the arch 521*a*. An aluminum member adjustment cam 582 serving as a position adjuster contacts the aluminum member 521. Instead of the aluminum member adjustment plate 81 shown in FIG. 23, the fixing device 10V includes the aluminum member adjustment shaft assembly 82 serving as an interlock as shown in FIG. 15. The aluminum member adjustment shaft assembly 82 includes the shafts 83 and the gears 84 and is connected to the aluminum member adjustment cam 582 and the cam 70. The aluminum member adjustment shaft assembly 82 interlocks the cam 70 with the aluminum member adjustment cam 582 to move or rotate the aluminum member adjustment cam 582 in accordance with rotation of the cam 70.

The aluminum member adjustment cam 582, as it rotates, reversibly lifts the aluminum member 521 to move the aluminum member 521 toward the heating pad 420 and lowers the aluminum member 521 to move the aluminum member 521 away from the heating pad 420. The aluminum member adjustment cam 582 is semicylindrical. As an arch face 582*a*, that is, an outer circumferential face, of the aluminum member adjustment cam 582 contacts the aluminum member 521, the aluminum member 521 is at the proximate position in proximity to the heating pad 420. Conversely, as a planar face 582*b* of the aluminum member adjustment cam 582 contacts the aluminum member 521, the aluminum member 521 is at the remote position being remote from the heating pad 420.

FIGS. 29 and 30 illustrate the position of the components of the fixing device 10V as the pressure roller 60 is pressed against the fixing roller 30 via the fixing belt 40 to convey the recording medium P through the fixing nip N. FIG. 29 is a sectional view of the fixing device 10V. FIG. 30 is a perspective view of the fixing device 10V illustrating one lateral end of the heating pad 420, the fixing roller 30, and the pressure roller 60 in the axial direction thereof. FIG. 30 does not illustrate the fixing belt 40.

As the cam 70 rotates and moves the pressure roller 60 toward the fixing belt 40 in the pressurization direction D2, the pressure roller 60 is pressed against the fixing roller 30 via the fixing belt 40 with increased pressure, forming the fixing nip N between the fixing belt 40 and the pressure roller 60. As the cam 70 and the aluminum member adjustment cam 582 rotate via interlocking of the aluminum member adjustment shaft assembly 82, the aluminum member 521 contacted by the aluminum member adjustment cam 582 also moves in the pressurization direction D2 in which the pressure roller 60 moves. The aluminum member 521 moves leftward in FIG. 29 in the radius-of-curvature direction of the heating pad 420 corresponding to the pressurization direction D2 of the pressure roller 60 to the proximate position in proximity to the heating pad 420 where the first interval in a range of from about 0.4 mm to about 2.0 mm is provided between the aluminum member 521 and the heating pad 420. A magnetic flux generated by the induction heater 50 penetrates through the magnetic shunt alloy of the heating pad 420 at the overheating portion of the fixing belt 40 where the recording medium P is not conveyed and is screened by the aluminum member 521 situated inside the heating pad 420. Accordingly, overheating of the fixing belt 40 is prevented.

Figure 31:
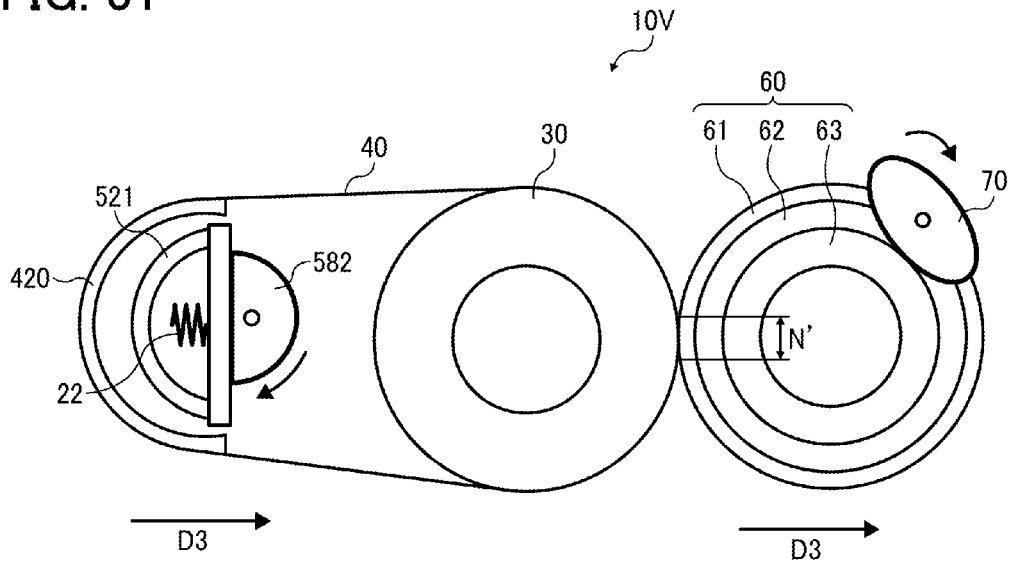
FIG. 31 is a schematic vertical sectional view of the fixing device shown in FIG. 29 as the pressure roller releases pressure exerted to the fixing belt.
Figure 32:
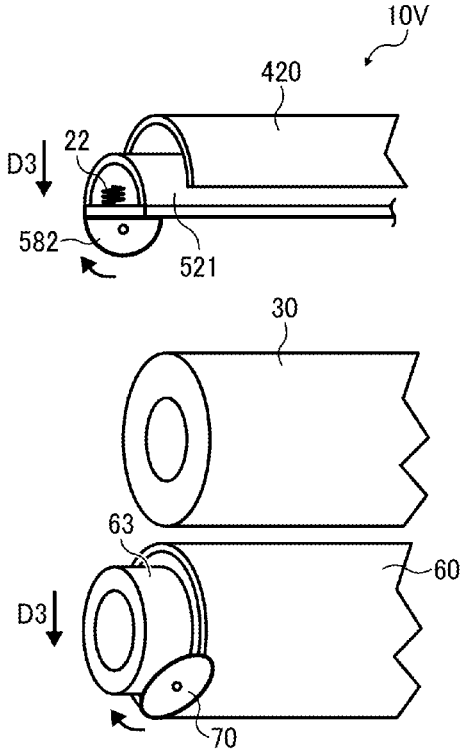
FIG. 32 is a partial schematic perspective view of the fixing device shown in FIG. 31.

FIGS. 31 and 32 illustrate the position of the components of the fixing device 10V as the pressure roller 60 releases pressure exerted to the fixing roller 30 via the fixing belt 40 to warm up the fixing device 10V. FIG. 31 is a schematic vertical sectional view of the fixing device 10V. FIG. 32 is a partial schematic perspective view of the fixing device 10V illustrating one lateral end of the heating pad 420, the fixing roller 30, and the pressure roller 60 in the axial direction thereof. FIG. 32 does not illustrate the fixing belt 40.

As the cam 70 rotates and moves the pressure roller 60 away from the fixing belt 40 in the depressurization direction D3, the pressure roller 60 is pressed against the fixing roller 30 via the fixing belt 40 with decreased pressure or no pressure, forming the fixing nip N' between the fixing belt 40 and the pressure roller 60. According to this example embodiment, even when the pressure roller 60 is pressed against the fixing roller 30 via the fixing belt 40 with decreased pressure, the fixing nip N' is formed between the fixing belt 40 and the pressure roller 60. Alternatively, the pressure roller 60 may be isolated from the fixing belt 40, forming no fixing nip therebetween.

As the cam 70 and the aluminum member adjustment cam 582 rotate via interlocking of the aluminum member adjustment shaft assembly 82, the aluminum member 521 contacted by the aluminum member adjustment cam 582 also moves in the depressurization direction D3 in which the pressure roller 60 moves. The aluminum member 521 moves rightward in FIG. 31 in the radius-of-curvature direction of the heating pad 420 corresponding to the depressurization direction D3 of the pressure roller 60 to the remote position being remote from the heating pad 420 where the second interval greater than the first interval created as the fixing nip N is formed between the fixing belt 40 and the pressure roller 60 as shown in FIG. 29 by a distance in a range of from about 2.0 mm to about 5.0 mm provided between the aluminum member 521 and the heating pad 420. As shown in FIG. 31, since a sufficient interval is provided between the heating pad 420 and the aluminum member 521, even when the temperature of the magnetic shunt alloy of the heating pad 420 reaches a temperature near the Curie temperature, a magnetic flux generated by the induction heater 50 barely penetrates through the heating pad 420 and most of input power is consumed by the heating pad 420. Accordingly, the fixing device 10V is warmed up for a shortened time. In addition to a warm-up period, while no recording medium P is conveyed through the fixing device 10V or while the fixing device 10V is in the energy saver mode or the like, the aluminum member 521 and the heating pad 420 are positioned as shown in FIGS. 31 and 32, enhancing heating efficiency of the heating pad 420.

Figure 33:
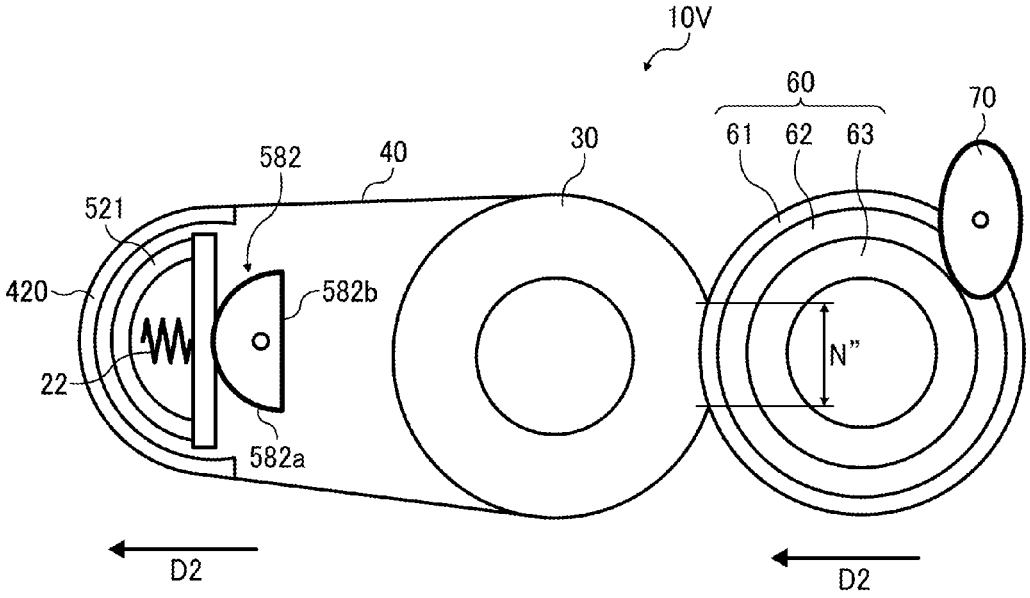
FIG. 33 is a schematic vertical sectional view of the fixing device as the pressure roller is pressed against the fixing belt with intermediate pressure.

FIG. 33 is a schematic vertical sectional view of the fixing device 10V. As shown in FIG. 33, the cam 70, as it rotates, adjusts the position of the pressure roller 60, pressing the pressure roller 60 against the fixing roller 30 via the fixing belt 40 with intermediate pressure between the pressure roller 60 and the fixing belt 40 that is intermediate between increased pressure and decreased pressure. For example, as the pressure roller 60 is pressed against the fixing roller 30 via the fixing belt 40 with intermediate pressure, that is intermediate between increased pressure to form the fixing nip N depicted in FIG. 29 and decreased pressure to form the fixing nip N' depicted in FIG. 31, to form a fixing nip N" between the fixing belt 40 and the pressure roller 60, the area of the fixing nip N" is intermediate between the area of the fixing nip N and the area of the fixing nip N'. The aluminum member 521 contacts the arch face 582*a* of the aluminum member adjustment cam 582. While the aluminum member 521 contacts the arch face 582*a* of the aluminum member adjustment cam 582 for a given time, the aluminum member 521 is at the proximate position in proximity to the heating pad 420. Thus, even after a plurality of recording media P is conveyed over the fixing belt 40 continuously, the fixing belt 40 is immune from overheating in the non-conveyance span thereof where the recording media P are not conveyed and therefore do not draw heat from the fixing belt 40. The configuration of the aluminum member adjustment cam 582 is not limited to that of this example embodiment. According to this example embodiment, the aluminum member 521 serving as a magnetic shield moves in the radius-of-curvature direction of the heating pad 420. Alternatively, the aluminum member 521 may move in the circumferential direction of the heating pad 420.

With the construction of the fixing device 10V described above, the pressure roller 60 is pressed against the fixing roller 30 via the fixing belt 40 with three levels of pressure, that is, increased pressure to form the fixing nip N, decreased pressure to form the fixing nip N', and intermediate pressure to form the fixing nip N". Accordingly, while a plurality of recording media P is conveyed through the fixing nip N or N" continuously, the aluminum member 521 is spaced apart from the heating pad 420 with a constant interval therebetween, regardless of increased pressure or intermediate pressure exerted at the fixing nip N or N". Thus, pressure exerted at the fixing nip N or N" is switched between two levels of pressure, that is, increased pressure and intermediate pressure. Consequently, pressure exerted between the pressure roller 60 and the fixing belt 40 and the temperature of the fixing belt 40 are controlled according to the type of the recording medium P and the type of the toner image T formed on the recording medium P, resulting in formation of the high quality toner image T fixed on the recording medium P.

Figure 34:
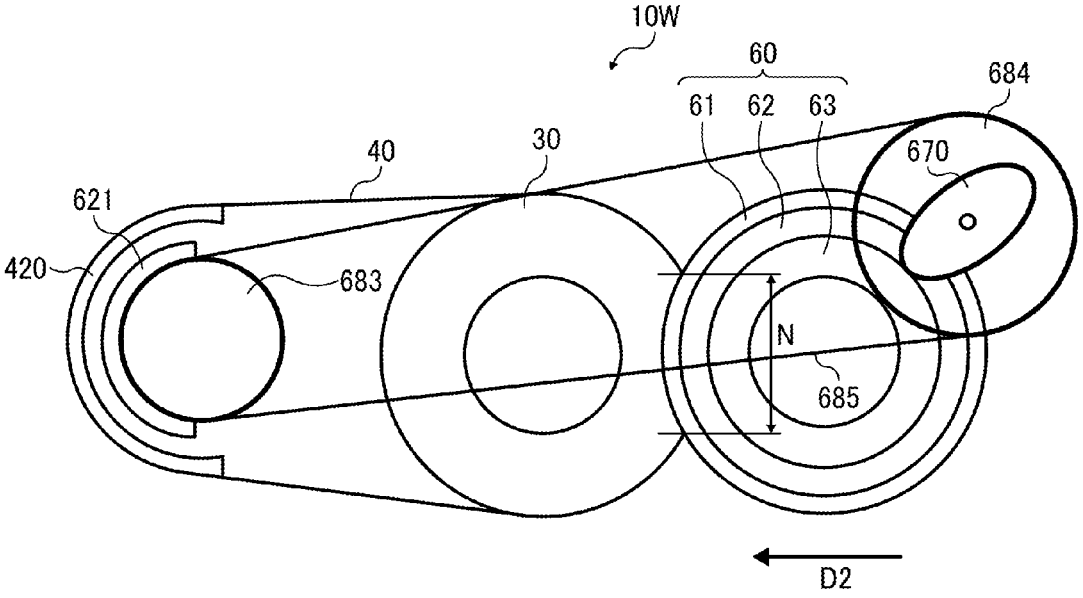
FIG. 34 is a schematic vertical sectional view of a fixing device according to a sixth example embodiment.
Figure 35:
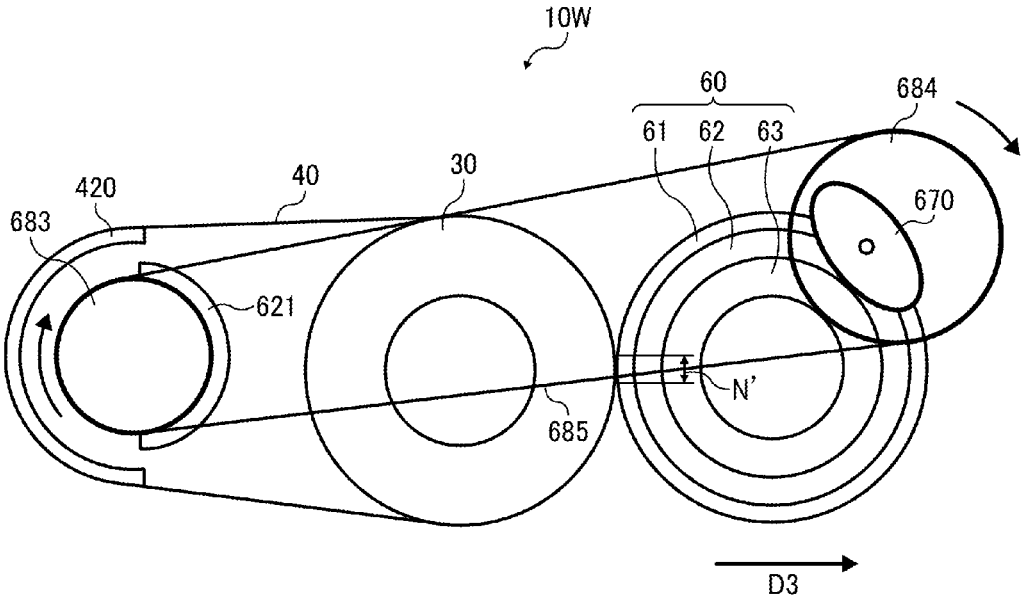
FIG. 35 is a schematic vertical sectional view of the fixing device shown in FIG. 34 as the pressure roller releases pressure exerted to the fixing belt.

With reference to FIGS. 34 and 35, a description is provided of a construction of a fixing device 10W according to a sixth example embodiment.

Identical reference numerals are assigned to components equivalent to the components incorporated in the fixing device 10U according to the fourth example embodiment shown in FIG. 23 and a detailed description of those components is omitted.

The fixing device 10W according to the sixth example embodiment includes a magnetic shield and an interlock that are different from those of the fixing device 10U according to the fourth example embodiment. FIG. 34 is a schematic vertical sectional view of the fixing device 10W. As shown in FIG. 34, the fixing device IOW includes a semicylindrical or arcuate aluminum member 621. The aluminum member 621 is connected to an aluminum member side pulley 683 serving as a position adjuster. A cam 670 is connected to or attached to a cam side pulley 684. A pulley belt 685 serving as an interlock is stretched taut across the aluminum member side pulley 683 and the cam side pulley 684. The aluminum member 621 and the cam 670 are rotatable through interlocking by the pulley belt 685.

FIG. 34 illustrates the position of the components of the fixing device 10W as the pressure roller 60 is pressed against the fixing roller 30 via the fixing belt 40 to convey the recording medium P through the fixing nip N. As the cam 670 rotates and moves the pressure roller 60 toward the fixing belt 40 in the pressurization direction D2, the pressure roller 60 is pressed against the fixing roller 30 via the fixing belt 40 with increased pressure, forming the fixing nip N between the fixing belt 40 and the pressure roller 60. As the cam 670 and the aluminum member 621 rotate through interlocking of the pulley belt 685, the aluminum member 621 rotates in the circumferential direction of the heating pad 420 by 180 degrees. The aluminum member 621 moves to the proximate position in proximity to the heating pad 420 where the first interval in a range of from about 0.4 mm to about 2.0 mm is provided between the aluminum member 621 and the heating pad 420. A magnetic flux generated by the induction heater 50 penetrates through the magnetic shunt alloy of the heating pad 420 at the overheating portion of the fixing belt 40 where the recording medium P is not conveyed and is screened by the aluminum member 621 situated inside the heating pad 420. Accordingly, overheating of the fixing belt 40 is prevented.

FIG. 35 is a schematic vertical sectional view of the fixing device 10W illustrating the position of the components of the fixing device 10W as the pressure roller 60 releases pressure exerted to the fixing roller 30 via the fixing belt 40 to warm up the fixing device 10W. As the cam 670 rotates and moves the pressure roller 60 away from the fixing belt 40 in the depressurization direction D3, the pressure roller 60 is pressed against the fixing roller 30 via the fixing belt 40 with decreased pressure, forming the fixing nip N' between the fixing belt 40 and the pressure roller 60. According to this example embodiment, even when the pressure roller 60 is pressed against the fixing roller 30 via the fixing belt 40 with decreased pressure, the fixing nip N' is formed between the fixing belt 40 and the pressure roller 60. Alternatively, the pressure roller 60 may be isolated from the fixing belt 40, forming no fixing nip therebetween.

As the cam 670 and the aluminum member 621 rotate through interlocking of the pulley belt 685, the aluminum member 621 rotates in the circumferential direction of the heating pad 420 by 180 degrees. The aluminum member 621 moves to the remote position being remote from the heating pad 420 where the second interval greater than the first interval created as the fixing nip N is formed between the fixing belt 40 and the pressure roller 60 as shown in FIG. 34 by a distance in a range of from about 10.0 mm to about 20.0 mm provided between the aluminum member 621 and the heating pad 420. As shown in FIG. 35, since a sufficient interval is provided between the heating pad 420 and the aluminum member 621, even when the temperature of the magnetic shunt alloy of the heating pad 420 reaches a temperature near the Curie temperature, a magnetic flux generated by the induction heater 50 barely penetrates through the heating pad 420 and most of input power is consumed by the heating pad 420. Accordingly, the fixing device 10W is warmed up for a shortened time. In addition to a warm-up period, while no recording medium P is conveyed through the fixing device IOW or while the fixing device 10W is in the energy saver mode or the like, the aluminum member 621 and the heating pad 420 are positioned as shown in FIG. 35, enhancing heating efficiency of the heating pad 420. According to this example embodiment, the aluminum member 621 serving as a magnetic shield moves in the circumferential direction of the heating pad 420. Alternatively, the aluminum member 621 may move in the radius-of-curvature direction of the heating pad 420.

Like the fixing device 10V according to the fifth example embodiment depicted in FIGS. 29 to 33, the fixing device 10W according to the sixth example embodiment may also adjust pressure exerted between the pressure roller 60 and the fixing belt 40 in three or more levels, that is, increased pressure, intermediate pressure, and decreased pressure. For example, two types of the aluminum member side pulley 683 used to produce increased pressure and intermediate pressure, respectively, are selectively actuated by a clutch or the like so that the aluminum member 621 is situated at the proximate position in proximity to the heating pad 420 as the pressure roller 60 is pressed against the fixing roller 30 via the fixing belt 40 with increased pressure or intermediate pressure.

The configurations of the fixing devices 10, 10S, 10T, 10U, 10V, and 10W are not limited to those of the first to sixth example embodiments described above.

The material and dimension of the components of the fixing devices 10, 10S 10T, 10U, 10V, and 10W described above are examples and modified as requested.

A description is provided of advantages of the fixing devices 10, 10S, 10T, 10U, 10V, and 10W depicted in FIGS. 2, 14, 20, 22, 29, and 34, respectively.

The fixing devices 10, 10S, 10T, 10U, 10V, and 10W include a fixing rotator (e.g., the fixing belt 40) rotatable in the rotation direction R to heat a toner image T on a recording medium P; a pressurization member (e.g., the pressure roller 60) pressed against the fixing rotator to form a fixing nip (e.g., the fixing nips N, N', and N") therebetween through which the recording medium P is conveyed; a magnetic flux generator (e.g., the induction heater 50), disposed opposite the fixing rotator, to generate a magnetic flux; a heat generator (e.g., the heating roller 20 and the heating pad 420) made of a magnetic shunt alloy and disposed opposite the magnetic flux generator to generate heat by the magnetic flux generated by the magnetic flux generator and heat the fixing rotator; a magnetic shield (e.g., the aluminum members 21, 221, 321, 521, and 621) movably disposed inside the heat generator to screen the magnetic flux penetrating through the heat generator; a pressure adjuster (e.g., cams 70, 370, and 670) to press the pressurization member against the fixing rotator with variable pressure; and an interlock (e.g., the aluminum member adjustment plate 81, the aluminum member adjustment shaft assembly 82, and the pulley belts 385 and 685) to interlock the pressure adjuster with the magnetic shield. The pressure adjuster presses the pressurization member against the fixing rotator with increased pressure to move the magnetic shield via the interlock to a proximate position in proximity to the heat generator and with decreased pressure to move the magnetic shield via the interlock to a remote position being remote from the heat generator.

Accordingly, the fixing devices 10, 10S, 10T, 10U, 10V, and 10W and the image forming apparatus 1 incorporating the fixing device 10, 10S, 10T, 10U, 10V, or 10W shorten a warm-up thereof with the simple structure of the fixing devices 10, 10S, 10T, 10U, 10V, and 10W.

According to the example embodiments described above, the fixing belt 40 serves as a fixing rotator or a fixing member. Alternatively, a fixing film, a fixing roller, or the like may be used as a fixing rotator or a fixing member. Further, the pressure roller 60 serves as a pressurization member. Alternatively, a pressure belt or the like may be used as a pressurization member.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotator rotatable in a given direction of rotation to heat a toner image on a recording medium;

a pressurization member pressed against the fixing rotator to form a fixing nip therebetween through which the recording medium is conveyed;

a magnetic flux generator, disposed opposite the fixing rotator, to generate a magnetic flux;

a heat generator made of a magnetic shunt alloy and disposed opposite the magnetic flux generator to generate heat by the magnetic flux generated by the magnetic flux generator and heat the fixing rotator;

a magnetic shield movably disposed inside the heat generator to screen the magnetic flux penetrating through the heat generator;

a pressure adjuster to press the pressurization member against the fixing rotator with variable pressure; and an interlock to interlock the pressurization member with the magnetic shield, the pressure adjuster to press the pressurization member against the fixing rotator with increased pressure to move the magnetic shield via the interlock to a proximate position in proximity to the heat generator and with decreased pressure to move the magnetic shield via the interlock to a remote position being remote from the heat generator.

2. The fixing device according to claim 1, wherein the interlock contacts the pressurization member and the magnetic shield.

3. The fixing device according to claim 1, further comprising a position adjuster contacting the magnetic shield to move the magnetic shield, wherein the interlock contacts the pressure adjuster and the position adjuster.

4. The fixing device according to claim 3, wherein the position adjuster includes a cam contacting the magnetic shield and rotatable to move the magnetic shield in a diametrical direction of the heat generator.

5. The fixing device according to claim 1, further comprising a driver connected to the pressure adjuster and the magnetic shield to drive the pressure adjuster and the magnetic shield.

6. The fixing device according to claim 1, wherein the pressure adjuster presses the pressurization member against the fixing rotator with decreased pressure while the recording medium is not conveyed through the fixing nip.

7. The fixing device according to claim 1, wherein the pressure adjuster presses the pressurization member against the fixing rotator with decreased pressure while the fixing device is warmed up.

8. The fixing device according to claim 1, wherein the pressure adjuster presses the pressurization member against the fixing rotator with decreased pressure while the fixing device is in an energy saver mode.

9. The fixing device according to claim 1, wherein the heat generator is rotatable and the magnetic shield is movable in a diametrical direction of the heat generator.

10. The fixing device according to claim 1, wherein the heat generator is rotatable and the magnetic shield is movable in a circumferential direction of the heat generator.

11. The fixing device according to claim 1, wherein the heat generator is not rotatable and the fixing rotator slides over the heat generator.

12. The fixing device according to claim 11, wherein the heat generator includes a semicylinder projecting toward the magnetic flux generator.

13. The fixing device according to claim 12, wherein the magnetic shield moves in a radius-of-curvature direction of the heat generator.

14. The fixing device according to claim 12, wherein the magnetic shield moves in a circumferential direction of the heat generator.

15. The fixing device according to claim 1, wherein the magnetic shield does not move for a given time as the pressure adjuster presses the pressurization member against the fixing rotator with increased pressure and with decreased pressure.

16. The fixing device according to claim 1, wherein the heat generator includes one of a rotatable heating roller and a stationary heating pad that contacts the fixing rotator.

17. The fixing device according to claim 1, further comprising a compression spring to bias the magnetic shield against the interlock, wherein the magnetic shield is made of aluminum.

18. The fixing device according to claim 1, wherein the pressure adjuster includes a cam contacting the pressurization member and rotatable to press the pressurization member against the fixing rotator with variable pressure.

19. The fixing device according to claim 1, wherein the interlock includes one of a plate, a shaft, and a belt.

20. An image forming apparatus comprising:

an image forming device to form a toner image; and a fixing device, disposed downstream from the image forming device in a recording medium conveyance direction, to fix the toner image on a recording medium, the fixing device including:

a fixing rotator rotatable in a given direction of rotation to heat the toner image on the recording medium;

a pressurization member pressed against the fixing rotator to form a fixing nip therebetween through which the recording medium is conveyed;

a magnetic flux generator, disposed opposite the fixing rotator, to generate a magnetic flux;

a heat generator made of a magnetic shunt alloy and disposed opposite the magnetic flux generator to generate heat by the magnetic flux generated by the magnetic flux generator and heat the fixing rotator;

a magnetic shield movably disposed inside the heat generator to screen the magnetic flux penetrating through the heat generator;

a pressure adjuster to press the pressurization member against the fixing rotator with variable pressure; and an interlock to interlock the pressurization member with the magnetic shield, the pressure adjuster to press the pressurization member against the fixing rotator with increased pressure to move the magnetic shield via the interlock to a proximate position in proximity to the heat generator and with decreased pressure to move the magnetic shield via the interlock to a remote position being remote from the heat generator.

* * * * *